US011352567B2

(12) United States Patent
Harandi et al.

(10) Patent No.: US 11,352,567 B2
(45) Date of Patent: Jun. 7, 2022

(54) PROCESSES FOR CONVERTING ORGANIC MATERIAL-CONTAINING FEEDS VIA PYROLYSIS

(71) Applicant: ExxonMobil Chemical Patents Inc., Baytown, TX (US)

(72) Inventors: Mohsen N. Harandi, New Hope, PA (US); Paul F. Keusenkothen, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 16/942,948

(22) Filed: Jul. 30, 2020

(65) Prior Publication Data

US 2021/0032545 A1 Feb. 4, 2021

Related U.S. Application Data

(60) Provisional application No. 62/938,392, filed on Nov. 21, 2019, provisional application No. 62/882,218, filed on Aug. 2, 2019.

(51) Int. Cl.

| | |
|---|---|
| ***C10G 1/00*** | (2006.01) |
| ***C10G 9/32*** | (2006.01) |
| ***C10G 1/10*** | (2006.01) |

(52) U.S. Cl.

CPC ..... *C10G 1/10* (2013.01); *C10G 1/002* (2013.01); *C10G 2300/1003* (2013.01); *C10G 2400/06* (2013.01); *C10G 2400/20* (2013.01); *C10G 2400/22* (2013.01)

(58) Field of Classification Search

CPC . C10G 1/00; C10G 1/002; C10G 9/32; C10G 2300/1003; C10G 2400/20; C10G 2400/22

See application file for complete search history.

(56) References Cited

U.S. PATENT DOCUMENTS 3,719,029 A * 3/1973 Suzukawa ..... C07C 11/00 95/211
3,848,016 A * 11/1974 Kono ..... B01J 8/28 585/635
4,097,363 A * 6/1978 McKinney ..... C10G 9/32 208/127
4,318,800 A 3/1982 Woebcke et al.
4,370,303 A 1/1983 Woebcke et al.
4,420,332 A 12/1983 Mori et al.
4,552,645 A 11/1985 Gartside et al.
4,828,681 A 5/1989 Yourtee et al.
5,364,995 A * 11/1994 Kirkwood ..... B01J 8/24 585/241
5,952,539 A * 9/1999 Seimandi ..... C10G 9/32 585/648
2020/0308497 A1* 10/2020 Harandi ..... B01D 3/06

FOREIGN PATENT DOCUMENTS

| | | |
|---|---|---|
| CA | 1108545 A | 8/1981 |
| WO | 2014/124011 A1 | 8/2014 |
| WO | 2014/140175 A1 | 9/2014 |

OTHER PUBLICATIONS

Adanez et al., "Selection of oxygen carriers for Chemical-looping Combustion" *Energy & Fuels*, American Chemical Society (Mar. 1, 2004) vol. 18, No. 2, pp. 371-377.
"BASF Cracker Makes Ethylene from Crude Oil" *Industrial and Engineering Chemistry* (Nov. 1961) vol. 53, No. 11.
Corma et al., "Crude Oil to Chemicals: Light Olefins from Crude Oil" *Catalyst Science and Technology* (2017) vol. 7, pp. 12-46.
Cavani et al., "Oxidative Dehydrogenation of Ethane and Propane: How Far from Commercial Implementation", *Catalysis Today* 127 (2007) pp. 113-131.
Gartside et al., "Thermal Regenerative Cracker: A Development Update", CEP Mar. 1982, pp. 82-85.

* cited by examiner

*Primary Examiner* — Randy Boyer

(57) ABSTRACT

Processes for converting an organic-material-containing feed comprising contacting the feed with a plurality of fluidized hot particles in a pyrolysis zone to product a first pyrolysis effluent, optionally contacting the first pyrolysis effluent with a quenching stream to impart additional pyrolysis of organic materials contained in the quenching stream, separating at least a portion of the particles and feeding them to a combustion zone where the particles are heated to an elevated temperature, optionally contacting the combustion zone effluent with a second organic-material-containing stream to produce, e.g., syngas, and feeding at least a portion of the heated particles to the pyrolysis zone.

21 Claims, 3 Drawing Sheets

PROCESSES FOR CONVERTING ORGANIC MATERIAL-CONTAINING FEEDS VIA PYROLYSIS

CROSS-REFERENCE TO RELATED APPLICATIONS

This application claims priority to and the benefit of U.S. Ser. No. 62/938,392, filed Aug. 2, 2019, and U.S. Ser. No. 62/882,218, filed Aug. 2, 2019, the disclosures of which are incorporated herein by their reference.

FIELD

This disclosure relates to processes and systems for converting organic feeds into chemical products. In particular, this disclosure relates to processes and systems for converting an organic-material-containing stream by pyrolysis to produce various products, e.g., olefins and fuel oil products. The processes and systems of this disclosure can be particularly useful in recycling plastic wastes and/or organic waste-streams produced in a refinery or chemical plant.

BACKGROUND

Steam cracking, also referred to as pyrolysis, has long been used to crack various hydrocarbon-containing feeds into olefins, preferably light olefins such as ethylene, propylene, and butenes. Conventional steam cracking utilizes a pyrolysis furnace ("steam cracker") that has two main sections: a convection section and a radiant section. The hydrocarbon-containing feed typically enters the convection section of the furnace as a liquid (except for light feedstocks that typically enter as a vapor) where the feedstock is typically heated and vaporized by indirect heat exchange with a hot flue gas from the radiant section and by direct contact with steam. The vaporized feedstock and steam mixture is fed into the radiant section where the cracking takes place. The resulting pyrolysis effluent, including olefins, leaves the pyrolysis furnace for further downstream processing, including quenching.

Conventional pyrolysis furnaces do not have the flexibility to process residues, crudes, or many residues, crude gas oils, or naphthas that are contaminated with non-volatile components. Non-volatile components, if present in the feed, typically cause fouling within the radiant section of the pyrolysis furnace. An external vaporization drum or flash drum has been implemented to separate vaporized hydrocarbons from liquid hydrocarbons to address the fouling problems in the pyrolysis furnace. The vaporized hydrocarbons are then cracked in the pyrolysis furnace and the liquid hydrocarbons that include nonvolatile components are removed and used as fuel. The liquid hydrocarbons, however, still contain a substantial quantity of hydrocarbons which, if converted into higher-value lighter hydrocarbons such as olefins via cracking, would bring substantial additional value to the crude oil feed. Thus, for decades the petrochemical industry has been trying to take advantage of relatively low-cost heavy crude oil to make substantial quantities of valuable chemicals such as olefins. The large amount of non-volatiles in the low-cost heavy crude oil, however, requires extensive and expensive processing.

Recycling of organic wastes, such as plastic waste has lately become an industry focus due to the environmental benefit. It would be highly desirable to convert plastic waste directly into valuable chemical products such as olefins and fuel products.

In a refinery or a chemical plant, various waste streams containing organic materials such as hydrocarbons, aqueous or oil-based, can be produced. Non-limiting examples of such waste streams include: waste water from the boots of fractionators, water-containing condensate streams from condensers, tar streams, and the like. It would be highly desirable to convert the organic materials, especially hydrocarbons, contained in the waste streams, preferably by feeding such waste streams directly into a converter without a separation step, into valuable chemical products such as olefins and/or fuel products.

There is a need, therefore, for improved processes and systems for converting various organic waste-containing materials, such as plastic waste and industrial waste streams produced in a refiner or chemical plant, into valuable chemical products such as olefins and/or chemical products.

This disclosure satisfies this and other needs.

SUMMARY

It has been found that in a pyrolysis process/system for converting a hydrocarbon-containing feed such as a resid-containing fraction of a crude comprising a step of contacting the hydrocarbon-containing feed with a plurality of heated solid particles at a temperature sufficient in a pyrolysis reaction zone to effect pyrolysis of hydrocarbons contained in the feed to produce a first pyrolysis effluent comprising olefins, the first pyrolysis effluent, still having a sufficiently high temperature, can be allowed to contact an organic-material-containing stream (e.g., a plastic-waste-containing stream) to further effect pyrolysis of the organic waste to convert the organic waste into olefins and/or lighter organic materials and obtain a second pyrolysis effluent. The solid particles separated from the first pyrolysis effluent and/or the second pyrolysis effluent can be supplied into a combustion zone where they are combusted and heated to a high temperature, and then recycled back to the pyrolysis reaction zone. Furthermore, after the particles exited the combustion zone but before they reach the pyrolysis zone, they may be allowed to contact an organic-material-containing stream (e.g., a waste stream produced in a refinery or chemical plant) to effect the conversion of the organic waste into valuable syngas. A pyrolysis process/system can be conveniently and effectively convert organic-waste-containing streams into valuable products such as olefins, fuel products, and syngas. Thus, a first aspect of this disclosure relates to a process for converting a hydrocarbon-containing feed by pyrolysis, comprising: (I) feeding the hydrocarbon-containing feed into a pyrolysis reaction zone; (II) feeding a plurality of fluidized particles having a first temperature into the pyrolysis reaction zone, wherein the first temperature is sufficiently high to enable pyrolysis of at least a portion of the hydrocarbon-containing feed on contacting the particles; (III) contacting at least a portion of the hydrocarbon-containing feed with the particles in the pyrolysis reaction zone to effect pyrolysis of at least a portion of the hydrocarbon-containing feed to produce a first pyrolysis effluent comprising olefins, hydrogen, and the particles; (IV) contacting at least a portion of the particles in the first pyrolysis effluent downstream of the pyrolysis reaction zone with a first quenching stream comprising an organic material to effect the pyrolysis of at least a portion of the organic material in the first quenching stream and obtain a second pyrolysis effluent comprising olefins, hydrogen, and the particles; and (V) separating the second pyrolysis effluent to obtain a first hydrocarbon stream rich in hydrocarbons and a first particle stream rich in the particles.

A second aspect of this disclosure relates to a process for A process for converting an organic-material-containing feed, the process comprising: (I) feeding a hydrocarbon-containing feed into a pyrolysis reaction zone; (II) feeding a plurality of fluidized particles having a first temperature into the pyrolysis reaction zone, wherein the first temperature is sufficiently high to enable pyrolysis of at least a portion of the hydrocarbon-containing feed on contacting the particles; (III) contacting at least a portion of the hydrocarbon-containing feed with the particles in the pyrolysis reaction zone to effect pyrolysis of at least a portion of the hydrocarbon-containing feed to produce a first pyrolysis effluent comprising olefins, hydrogen, and the particles; (IV) optionally contacting at least a portion of the particles in the first pyrolysis effluent downstream of the pyrolysis reaction zone with a first quenching stream comprising a first organic material to effect the pyrolysis of at least a portion of the first organic material and to obtain a second pyrolysis effluent comprising olefins, hydrogen, and the particles; (V) separating the second pyrolysis effluent to obtain a first hydrocarbon stream rich in hydrocarbons and a first particle stream rich in the particles; (VI) heating at least a portion of the particles in the first particle stream in a combustion zone; (VII) feeding at least a portion of the heated particles to the pyrolysis reaction zone as at least a portion of the plurality of fluidized particles fed into the pyrolysis reaction zone in step (II); and (VIII) optionally between steps (VI) and (VII), contacting at least a portion of the heated particles with a second organic-material-containing stream comprising a second organic material; wherein at least one of steps (IV) and (VIII) is carried out.

DETAILED DESCRIPTION

Figure 1:
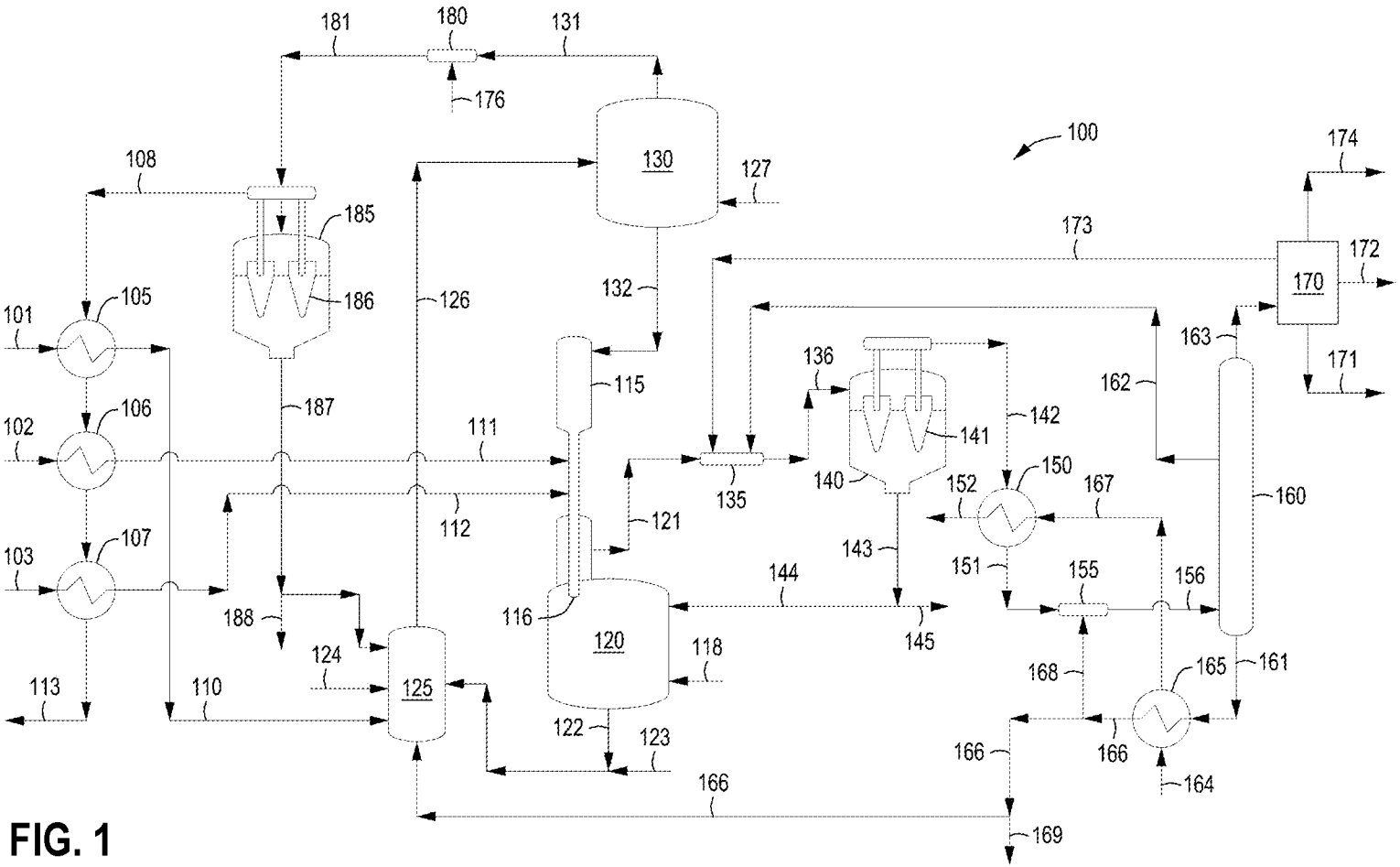
FIG. 1 depicts an illustrative process/system for converting a hydrocarbon-containing feed by pyrolysis, according to one or more embodiments described.

Various specific embodiments, versions and examples of the invention will now be described, including preferred embodiments and definitions that are adopted herein for purposes of understanding the claimed invention. While the following detailed description gives specific preferred embodiments, those skilled in the art will appreciate that these embodiments are exemplary only, and that the invention may be practiced in other ways. For purposes of determining infringement, the scope of the invention will refer to any one or more of the appended claims, including their equivalents, and elements or limitations that are equivalent to those that are recited. Any reference to the "invention" may refer to one or more, but not necessarily all, of the inventions defined by the claims.

In this disclosure, a process is described as comprising at least one "step." It should be understood that each step is an action or operation that may be carried out once or multiple times in the process, in a continuous or discontinuous fashion. Unless specified to the contrary or the context clearly indicates otherwise, multiple steps in a process may be conducted sequentially in the order as they are listed, with or without overlapping with one or more other steps, or in any other order, as the case may be. In addition, one or more or even all steps may be conducted simultaneously with regard to the same or different batch of material. For example, in a continuous process, while a first step in a process is being conducted with respect to a raw material just fed into the beginning of the process, a second step may be carried out simultaneously with respect to an intermediate material resulting from treating the raw materials fed into the process at an earlier time in the first step. Preferably, the steps are conducted in the order described.

Unless otherwise indicated, all numbers indicating quantities in this disclosure are to be understood as being modified by the term "about" in all instances. It should also be understood that the precise numerical values used in the specification and claims constitute specific embodiments. Efforts have been made to ensure the accuracy of the data in the examples. However, it should be understood that any measured data inherently contains a certain level of error due to the limitation of the technique and/or equipment used for making the measurement.

Certain embodiments and features are described herein using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated.

As used herein, the indefinite article "a" or "an" shall mean "at least one" unless specified to the contrary or the context clearly indicates otherwise. Thus, embodiments using "a pyrolysis reactor" include embodiments where one, two or more pyrolysis reactors are used, unless specified to the contrary or the context clearly indicates that only one pyrolysis reactor is used.

"Crude" or "crude oil" in this disclosure interchangeably means whole crude oil as it issues from a wellhead, production field facility, transportation facility, or other initial field processing facility, and/or crude that has been processed by a step of desalting, treating, and/or other steps as may be necessary to render it acceptable for conventional distillation in a refinery. Crude as used herein is presumed to contain resid.

"Crude fractions" as used herein mean hydrocarbon fractions obtainable from fractionation of a crude.

"Resid" as used herein refers to (i) the bottoms cut of a crude distillation process that contains non-volatile components, and/or (ii) a material comprising organic compounds such as hydrocarbons having boiling points in the boiling point range of a resid in category (i). Resids of category (i) are complex mixture of heavy petroleum compounds otherwise known in the art as residuum or residual. Atmospheric resid is the bottoms product produced from atmospheric distillation of a crude where a typical endpoint of the heaviest distilled product is nominally 650° F. (343° C.), and is referred to as 650° F. (343° C.) resid. The term "nominally" herein means that reasonable experts may disagree on the exact cut point for these terms, but by no more than +/−100° F. (+/−55.6° C.) preferably no more than +/−50° F. (+/−27.8° C.). Vacuum resid is the bottoms product from a distillation column operated under vacuum where the heaviest distilled product can be nominally 1050° F. (566° C.), and is referred to as 1050° F. (566° C.) resid. This 1050° F. (566° C.) portion contains high concentration of asphaltenes, which traditionally are considered to be problematic for the steam cracker, resulting in severe fouling and potentially corrosion or erosion of the apparatus. Vacuum resid can be advantageously mixed with a crude, and/or a lighter crude fraction such as an atmospheric resid to form a suitable feed supplied to the flashing drum of the process of this disclosure. Category (ii) resid in this disclosure can include, e.g., (a) natural or synthetic polymer materials, such as polyethylene, polypropylene, polystyrene, polyvinyl chloride, and the like; (b) biofuel (e.g., biodiesel) derived from biological materials (e.g., lignin, plant waste, algae waste, and food waste); (c) biological materials such as algae, corn, soy; and (d) any mixture of one or more of (a), (b), and/or (c).

The term "non-volatile components" as used herein refers to the fraction of a hydrocarbon-containing feed, e.g., a petroleum feed, having a nominal boiling point of at least 590° C., as measured by ASTM D6352-15 or D-2887-18. Non-volatile components include coke precursors, which are large, condensable molecules that condense in the vapor and then form coke during pyrolysis of the hydrocarbon-containing feed.

The term "hydrocarbon" as used herein means (i) any compound consisting of hydrogen and carbon atoms or (ii) any mixture of two or more such compounds in (i). The term "Cn hydrocarbon," where n is a positive integer, means (i) any hydrocarbon compound comprising carbon atom(s) in its molecule at the total number of n, or (ii) any mixture of two or more such hydrocarbon compounds in (i). Thus, a C2 hydrocarbon can be ethane, ethylene, acetylene, or mixtures of at least two of these compounds at any proportion. A "Cm to Cn hydrocarbon" or "Cm-Cn hydrocarbon," where m and n are positive integers and m<n, means any of Cm, Cm+1, Cm+2, . . . , Cn−1, Cn hydrocarbons, or any mixtures of two or more thereof. Thus, a "C2 to C3 hydrocarbon" or "C2-C3 hydrocarbon" can be any of ethane, ethylene, acetylene, propane, propene, propyne, propadiene, cyclopropane, and any mixtures of two or more thereof at any proportion between and among the components. A "saturated C2-C3 hydrocarbon" can be ethane, propane, cyclopropane, or any mixture thereof of two or more thereof at any proportion. A "Cn+ hydrocarbon" means (i) any hydrocarbon compound comprising carbon atom(s) in its molecule at the total number of at least n, or (ii) any mixture of two or more such hydrocarbon compounds in (i). A "Cn− hydrocarbon" means (i) any hydrocarbon compound comprising carbon atoms in its molecule at the total number of at most n, or (ii) any mixture of two or more such hydrocarbon compounds in (i). A "Cm hydrocarbon stream" means a hydrocarbon stream consisting essentially of Cm hydrocarbon(s). A "Cm-Cn hydrocarbon stream" means a hydrocarbon stream consisting essentially of Cm-Cn hydrocarbon(s).

The term "olefin product" as used herein means a product that includes an olefin, preferably a product consisting essentially of an olefin. An olefin product in the meaning of this disclosure can be, e.g., an ethylene stream, a propylene stream, a butylene stream, an ethylene/propylene mixture stream, and the like.

The term "consisting essentially of" as used herein means the composition, feed, effluent, product, or other stream comprises a given component at a concentration of at least 60 wt %, preferably at least 70 wt %, more preferably at least 80 wt %, more preferably at least 90 wt %, still more preferably at least 95 wt %, based on the total weight of the composition, feed, effluent, product, or other stream in question.

The term "rich" when used in phrases such as "X-rich" or "rich in X" means, with respect to an outgoing stream obtained from a device, that the stream comprises material X at a concentration higher than in the feed material fed to the same device from which the stream is derived.

The term "lean" when used in phrases such as "X-lean" or "lean in X" means, with respect to an outgoing stream obtained from a device, that the stream comprises material X at a concentration lower than in the feed material fed to the same device from which the stream is derived.

The terms "channel" and "line" are used interchangeably and mean any conduit configured or adapted for feeding, flowing, and/or discharging a gas, a liquid, and/or a fluidized solids feed into the conduit, through the conduit, and/or out of the conduit, respectively. For example, a composition can be fed into the conduit, flow through the conduit, and/or discharge from the conduit to move the composition from a first location to a second location. Suitable conduits can be or can include, but are not limited to, pipes, hoses, ducts, tubes, and the like.

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All concentrations herein are expressed on the basis of the total amount of the composition in question, unless specified otherwise. Thus, the concentrations of the various components of the "hydrocarbon-containing feed" are expressed based on the total weight of the hydrocarbon-containing feed. All ranges expressed herein should include both end points as two specific embodiments unless specified or indicated to the contrary.

Nomenclature of elements and groups thereof used herein are pursuant to the Periodic Table used by the International Union of Pure and Applied Chemistry after 1988. An example of the Periodic Table is shown in the inner page of the front cover of Advanced Inorganic Chemistry, $6^{th}$ Edition, by F. Albert Cotton et al. (John Wiley & Sons, Inc., 1999).

A typical crude includes a mixture of hydrocarbons with varying carbon numbers and boiling points. Thus, by using conventional atmospheric distillation and vacuum distillation, one can produce a range of fuel products with varying boiling points: naphtha, gasoline, kerosene, distillate, and tar. It is highly desired, however, to convert the large hydrocarbon molecules contained in the crude into more valuable, lighter products including but not limited to ethylene, propylene, butylenes, and the like, which can be further made into more valuable products such as polyethylene, polypropylene, ethylene-propylene copolymers, butyl rubbers, and the like.

The hydrocarbon-containing feed, the first organic-material-containing stream, and/or the second organic-material-containing stream can be, can include, or can be derived from petroleum, plastic, natural gas condensate, landfill gas (LFG), biogas, coal, biomass, biobased oils, rubber, or any mixture thereof. In certain embodiments, the hydrocarbon-containing feed, the first organic-material-containing stream, and/or the second organic-material-containing stream can include a non-volatile component. In certain embodiments, the petroleum can be or can include any crude or any mixture thereof, any crude fraction or any mixture thereof, or any mixture of any crude with any crude fraction. In certain embodiments, the petroleum can be or can include: atmospheric resid, vacuum resid, steam cracked gas oil and residue, gas oil, heating oil, hydrocrackate, atmospheric pipestill bottoms, vacuum pipestill streams including bottoms, gas oil condensate, heavy non-virgin hydrocarbon stream from refineries, vacuum gas oil, heavy gas oil, naphtha contaminated with crude, heavy residue, C4's/ residue admixture, naphtha/residue admixture, hydrocarbon gases/residue admixture, hydrogen/residue admixture, gas oil/residue admixture, or any mixture thereof. Non-limiting examples of crudes can be or can include, but are not limited to: Tapis, Murban, Arab Light, Arab Medium, and/or Arab Heavy as examples. Preferably, the first organic-material-containing stream comprises the hydrogen element at a concentration of ≥7 wt %, ≥8 wt %, ≥10 wt %, ≥12 wt %, ≥15 wt %, ≥16 wt %, ≥18 wt %, ≥20 wt %, ≥25 wt %, or even ≥30 wt %, based on the total weight of the first organic-material-containing stream. A high hydrogen content in the first organic-material-containing stream is conducive for the production of olefins and less coke. Preferably, the second organic-material-containing stream comprises the hydrogen element at a concentration of ≥10 wt %, ≥12 wt %, ≥15 wt %, ≥16 wt %, ≥18 wt %, ≥20 wt %, ≥25 wt %, or even ≥30 wt %, based on the total weight of the first organic-material-containing stream. A high hydrogen content in the second organic-material-containing stream is conducive for the production of syngas with a high molecular hydrogen content therein.

For the brevity of description, a plastic in this disclosure includes plastic and rubber materials. In certain embodiments, the plastic can be or can include polyethylene terephthalate (PETE or PET), polyethylene (PE), polypropylene (PP), polyvinyl chloride (PVC), polyvinylidene chloride (PVDC), polystyrene (PS), polycarbonate (PC), polylactic acid (PLA), acrylic (PMMA), acetal (polyoxymethylene, POM), acrylonitrile-butadiene-styrene (ABS), fiberglass, nylon (polyamides, PA), polyester (PES) rayon, polyoxybenzylmethylenglycolanhydride (bakelite), polyurethane (PU), polyepoxide (epoxy), or any mixture thereof. The rubber can be or can include natural rubber, synthetic rubber, or a mixture thereof. A plastic waste can include used plastic material and/or unused plastic material designated for recycling. A plastic waste may have been degraded and/or contaminated to various degree. Preferred plastic materials for the processes of this disclosure comprise hydrogen and carbon in the molecular structure thereof. The plastic material may further comprises heteroatoms such as nitrogen, oxygen, silica, sulfur, fluorine, chlorine, phosphorous, and the like, at various concentrations. Contaminated plastic waste may even comprise metal elements such as aluminum, tin, lead, and even mercury. Preferably the plastic waste are free of heavy metals such as mercury, lead, and bismuth.

In certain embodiments, the biomass can be or can include, but is not limited to, wood, agricultural residues such as straw, stover, cane trash, and green agricultural wastes, agro-industrial wastes such as sugarcane bagasse and rice husk, animal wastes such as cow manure and poultry litter, industrial waste such as black liquor from paper manufacturing, sewage, municipal solid waste, food processing waste, or any mixture thereof. In certain embodiments, the biogas can be produced via anaerobic digestion, e.g., the biogas produced during the anaerobic digestion of sewage. In certain embodiments, the biobased oil can be or can include oils that can degrade biologically over time. In certain embodiments, the biobased oil can be degraded via processes of bacterial decomposition and/or by the enzymatic biodegradation of other living organisms such as yeast, protozoans, and/or fungi. Biobased oils can be derived from vegetable oils, e.g., rapeseed oil, castor oil, palm oil, soybean oil, sunflower oil, corn oil, hemp oil, or chemically synthesized esters.

If the hydrocarbon-containing feed, the first organic-material-containing stream, and/or the second organic-material-containing stream includes material that is solid at room temperature (solid material), e.g., plastic, biomass, coal, and/or rubber, the solid material can be reduced to any desired particle size via well-known processes. For example, if the hydrocarbon-containing feed includes solid material, the solid material can be ground, crushed, pulverized, pelletized, or other otherwise reduced into particles that have any desired average particle size. In certain embodiments, the solid matter can be reduced to an average particle size that can be submicron or from about 1 μm, about 10 μm or about 50 μm to about 100 μm, about 150 μm, or about 200 μm. For example, the average particle size of the hydrocarbon feedstock, if solid matter, can range from about 75 μm to about 475 μm, from about 125 μm to about 425 μm, or about 175 μm to about 375 μm.

In certain embodiments, one or more vapor-liquid separators, e.g., a vaporization drum or a flashing drum, can be used to separate a hydrocarbon-containing feed, e.g., a raw crude oil or a desalted crude oil, to obtain an overhead vapor effluent and a bottoms liquid effluent. The bottoms liquid effluent can have a cutoff point from 300° C. to 700° C., e.g., 310° C. to 550° C., as measured according to ASTM D1160-18. The hydrocarbon-containing feed, the first the first organic-material-containing stream and/or the second organic-material-containing stream can be or can be obtained partly or entirely from the bottoms liquid effluent. In this embodiment, at least a portion of the overhead vapor effluent can optionally be fed into another processing unit, e.g., a radiant section of a steam cracker furnace, a fluid catalytic cracker, other systems capable of upgrading the overhead vapor effluent, or any combination thereof. Suitable vaporization drums or flashing drums can include those disclosed in U.S. Pat. Nos. 7,674,366; 7,718,049; 7,993,435; 8,105,479; and 9,777,227. In certain embodiments, if an overhead vapor and a liquid bottoms is separated from a hydrocarbon feed, the overhead vapor can be steam cracked according to the processes and systems disclosed in U.S. Pat. Nos. 6,419,885; 7,993,435; 9,637,694; and 9,777,227; U.S. Patent Application Publication No. 2018/0170832; and International Patent Application Publication No. WO 2018/111574.

Pyrolysis of the Hydrocarbon-Containing Feed

The processes for converting the hydrocarbon-containing feed, e.g., a crude oil or a fraction thereof, by pyrolysis disclosed herein can produce a pyrolysis effluent that can include, but is not limited to, olefins, e.g., ethylene, propylene, and/or one or more butenes, aromatics, e.g., benzene, toluene, and/or xylene, molecular hydrogen ($H_2$), or any mixture thereof. In certain embodiments, the hydrocarbon-containing feed can be introduced, supplied, or otherwise fed into a pyrolysis reaction zone. In certain embodiments, the hydrocarbon-containing feed can be heated, e.g., via indirect heat exchange with a heated medium, to a temperature in a range from 100° C., 150° C., or 200° C. to 300° C., 350° C., or 400° C., e.g., 250° C. to 300° C., prior to feeding the hydrocarbon-containing feed into the pyrolysis reaction zone.

A plurality of fluidized particles can also be introduced, supplied, or otherwise fed into the pyrolysis reaction zone. The plurality of fluidized particles can have a first temperature when fed into the pyrolysis reaction zone. The first temperature can be sufficiently high to enable pyrolysis of at least a portion of the hydrocarbon-containing feed or fraction thereof on contacting the particles within the pyrolysis reaction zone. The plurality of fluidized particles can include an oxide of a transition metal element capable of oxidizing molecular hydrogen ($H_2$) at the first temperature.

The hydrocarbon-containing feed can contact the plurality of fluidized particles in the pyrolysis reaction zone to effect pyrolysis of at least a portion of the hydrocarbon-containing feed to produce the first pyrolysis effluent that can include olefins, hydrogen, and the particles. In certain embodiments, the first pyrolysis effluent can be at a second temperature that can be lower than the first temperature. At least a portion of the transition metal element disposed on and/or in the particles in the first pyrolysis effluent can be at a reduced state as compared to the transition metal element in the plurality of fluidized particles fed into the pyrolysis reaction zone.

The first temperature can be 750° C., 800° C., 850° C., 900° C., or 950° C. to 1,050° C., 1,100° C., 1,200° C., 1,300° C., 1,400° C., or 1,500° C. In certain embodiments, the first temperature can be at least 800° C., at least 820° C., at least 840° C., at least 850° C., at least 875° C., at least 900° C., at least 950° C., or at least 975° C. to 1,000° C., 1,050° C., 1,100° C., 1,200° C., 1,300° C., or 1,400° C.

The hydrocarbon-containing feed can be contacted with an amount of the plurality of fluidized particles within the pyrolysis reaction zone sufficient to effect a desired level or degree of pyrolysis of the hydrocarbon-containing feed. In certain embodiments, a weight ratio of the plurality of fluidized particles to the hydrocarbon-containing feed when contacted within the pyrolysis reaction zone can be 5:1, 10:1, 12:1, 15:1, or 20:1 to 25:1, 30:1, 35:1, 40:1, 45:1, 50:1, 55:1, or 60:1.

The pyrolysis reaction zone can be located in any suitable reactor or other process environment capable of operating under the pyrolysis process conditions. In certain embodiments, the pyrolysis reaction zone can be located in short contact time fluid bed. In certain embodiments, the pyrolysis reaction zone can be located in a downflow reactor, an upflow reactor, a counter-current flow reactor, or vortex reactor. In a preferred embodiment, the pyrolysis reaction zone can be located in a downflow reactor.

In certain embodiments, the hydrocarbon-containing feed can be contacted with the plurality of fluidized particles in the pyrolysis reaction zone in the presence of steam, and/or the first quenching stream can be contacted with the plurality of fluidized particles in the first quenching zone in the presence of steam. The steam, if present, can be introduced or otherwise fed into the pyrolysis reaction zone and/or the first quenching zone in an amount sufficient to provide a weight ratio of the steam to the hydrocarbon-containing feed of 0.05:1, 0.1:1, 0.2:1, 0.25:1, 0.3:1, or 0.4:1 to 0.5:1, 0.6:1, 0.7:1, 0.8:1, 0.9:1, or 2:1. For example, the weight ratio of the steam to the hydrocarbon-containing feed in the pyrolysis zone, and/or the weight ratio of the steam to the first quenching stream can be about 0.2:1 to about 0.6:1 or about 0.3:1 to about 0.5:1.

The hydrocarbon-containing feed can contact the plurality of fluidized particles within the pyrolysis reaction zone, and/or the first quenching stream can contact the plurality of fluidized particles within the first quenching zone, under a vacuum, at atmospheric pressure, or at a pressure greater than atmospheric pressure. In certain embodiments, the hydrocarbon-containing feed can contact the plurality of fluidized particles within the pyrolysis reaction zone, and/or the first quenching stream can contact the plurality of fluidized particles within the first quenching zone, under an absolute pressure of 101 kPa, 150 kPa, 200 kPa, 250 kPa, 300 kPa, or 400 kPa to 450 kPa, 500 kPa, 550 kPa, 600 kPa, 650 kPa, 700 kPa, 750 kPa, 800 kPa, or 840 kPa. In certain embodiments, the hydrocarbon-containing feed can contact the plurality of fluidized particles within the pyrolysis reaction zone, and/or the first quenching stream can contact the plurality of fluidized particles within the first quenching zone, under an absolute pressure of 101 kPa to 800 kPa, 101 kPa to 700 kPa, 101 kPa to 500 kPa, 200 kPa to 800 kPa, 220 kPa to 460 kPa, or 101 kPa to 450 kPa. In certain other embodiments, the hydrocarbon-containing feed can contact the plurality of fluidized particles within the pyrolysis reaction zone, and/or the first quenching stream can contact the plurality of fluidized particles within the first quenching zone, under an absolute pressure of less than 800 kPa, less than 700 kPa, less than 600 kPa, less than 500 kPa, less than 450 kPa, less than 400 kPa, less than 350 kPa, less than 300 kPa, less than 250 kPa, less than 200 kPa, or less than 150 kPa.

The hydrocarbon-containing feed can contact the plurality of fluidized particles within the pyrolysis reaction zone, and/or the first quenching stream can contact the plurality of fluidized particles within the first quenching zone, separately and independently or in combination, for a residence time of 1 millisecond (ms), 5 ms, 10 ms, 25 ms, 50 ms, 75 ms, or 100 ms to 300 ms, 500 ms, 750 ms, 1,000 ms, 1,250 ms, 1,500 ms, 1,750 ms, or 2,000 ms. In certain embodiments, the hydrocarbon-containing feed can contact the plurality of fluidized particles within the pyrolysis reaction zone, and/or the first quenching stream can contact the plurality of fluidized particles within the first quenching zone, separately and independently or in combination, for a residence time of 10 ms to 500 ms, 10 ms to 100 ms, 20 ms to 200 ms, 30 ms to 225 ms, 50 ms to 250 ms, 125 ms to 500 ms, 200 ms to 600 ms, or 20 ms to 140 ms. In certain other embodiments, the hydrocarbon-containing feed can contact the plurality of fluidized particles within the pyrolysis reaction zone, and/or the first quenching stream can contact the plurality of fluidized particles within the first quenching zone, separately independently or in combination for a residence time of less than 1,000 ms, less than 800 ms, less than 600 ms, less than 400 ms, less than 300 ms, less than 200 ms, less than 150 ms, or less than 100 ms.

In certain embodiments of the processes of this disclosure, the fluidized particles can advantageously comprise an oxide of a transition metal element capable of oxidizing molecular hydrogen at the first temperature. Without wishing to be bound by theory, it is believed that the particles that include the oxide of the transition metal element capable of oxidizing molecular hydrogen at the first temperature can do so via one or more processes or mechanisms. Regardless of the overall mechanism, the oxidized transition metal element can facilitate the conversion of molecular hydrogen to water and in doing so the oxidation state of the oxide of the transition metal element can be reduced. For example, if the transition metal element is vanadium, the oxide of vanadium on the fluidized particles fed into the pyrolysis reaction zone can be at an oxidation state of +5 (for example) and at least a portion of the oxide of vanadium on the fluidized particles in the first pyrolysis effluent can be at an oxidation state of +4, +3, or +2. Without wishing to be bound by theory, it is also believed that one or more of the oxides of one or more transition metal elements may be capable of being reduced from an oxidized state all the way to the metallic state.

Additionally, the oxide of the transition metal element can favor the conversion, e.g., oxidation and/or combustion, of hydrogen over the oxidation and/or combustion of hydrocarbons, e.g., olefins, in the pyrolysis reaction zone and/or the first quenching zone. In certain embodiments, the oxide of the transition metal element can favor the conversion of hydrogen over the conversion of hydrocarbons at a rate of 2:1, 3:1, 4:1, 5:1, 6:1, or 7:1 to 8:1, 9:1, 10:1, or 11:1.

In certain embodiments, the presence of the oxide of the transition metal in the fluidized particles, e.g., disposed on an outer surface of the particles and/or at least partially within the particles, can reduce an amount of molecular hydrogen present in the first pyrolysis effluent and/or the second pyrolysis effluent as compared to a comparative pyrolysis effluent produced under the same process conditions and with the same fluidized particles except the oxide of the transition metal is absent. In certain embodiments, the amount of molecular hydrogen ($H_2$) in the first pyrolysis effluent and/or in the second pyrolysis effluent as compared to a comparative pyrolysis effluent can be independently reduced by 0.001%, 0.01%, or 0.05% to 0.07%, 0.08%, 0.09%, 0.1%, 0.15%, or 0.2% as compared to the comparative pyrolysis effluent. In certain other embodiments, the amount of molecular hydrogen ($H_2$) in the first pyrolysis effluent and/or in the second pyrolysis effluent as compared to a comparative pyrolysis effluent can reduced independently by at least 0.001%, at least 0.01%, at least 0.05%, or at least 0.07% as compared to the comparative pyrolysis effluent. In certain embodiments, the amount of molecular hydrogen present in the first pyrolysis effluent and/or the second pyrolysis effluent can be independently less than 3 wt %, less than 2.5 wt %, less than 2 wt %, less than 1.5 wt %, less than 1.4, less than 1.3 wt %, less than 1.2 wt %, less than 1.1 wt %, less than 1 wt %, less than 0.9 wt %, less than 0.8 wt %, less than 0.7 wt %, less than 0.6 wt %, less than 0.5 wt %, or less than 0.4 wt %. In certain embodiments, the amount of molecular hydrogen present in the first pyrolysis effluent and/or the second pyrolysis effluent can be independently 0.01 wt % to 2.5 wt %, 0.5 wt % to 2 wt %, or 1 wt % to 1.7 wt %.

In certain embodiments, during contact of the hydrocarbon-containing feed and/or the first quenching stream with the plurality of fluidized particles in the pyrolysis reaction zone and/or the first quenching zone, coke can be formed on the surface of the particles. For example, when the hydrocarbon-containing feed and/or the first quenching stream includes non-volatile components (e.g., polymers, resids) at least a portion of the non-volatile components can deposit, condense, adhere, or otherwise become disposed on the surface of the particles and/or at least partially within the particles, e.g., within pores of the particles, in the form of coke. As such, the first pyrolysis effluent and/or the second pyrolysis effluent can include the plurality of particles in which at least a portion of the transition metal element can be at a reduced state and at least a portion of the particles can include coke formed or otherwise disposed on the surface thereof and/or at least partially therein. In certain embodiments, the particles in the first pyrolysis effluent and/or the second pyrolysis effluent can independently include 1 wt %, 3 wt %, 5 wt %, 7 wt %, 10 wt %, or 15 wt % to 20 wt %, 25 wt %, 30 wt %, 35 wt %, 40 wt %, 45 wt %, or 50 wt % of coke, based on a total weight of the particles.

Fluidized Particles

The plurality of fluidized particles can comprise a glass material, a ceramic material, a glass-ceramic material, a crystalline material, or a composite or mixture of any two or more thereof. The particles can comprise, consist essentially of, or consist of: (i) one or more oxides of the following elements Li; Na; K; Be; Mg; Ca; Sr; Ba; B; Al; Ga; In; Si; Ge, Sn; P; Sc; Ti; V. Cr. Mn; Fe; Co; Ni; Cu; Zn; Y; Zr; Nb; Mo; Tc; the lanthanoids; Hf; Ta; W; and the actinoids; (ii) any composite of two or more of the oxides of (i); (iii) coke; and (iv) any mixture of two or more of (i), (ii), and (iii). The particles can be made of naturally occurring or synthetic materials. None-limiting examples of naturally occurring materials suitable for the particles include quartz sand, clay, granite particles, rutile, spodumene, zircon, and other refractory minerals. Non-limiting materials suitable for the particles include coke, spent FCC catalyst, and the like. In certain embodiments, the particles have a substantially homogeneous composition. In other embodiments, the particles can be or include a core and at least one transition metal element and/or at least one oxidized transition metal element disposed on and/or in the core. In certain embodiments, the core can be inert, i.e., inert during pyrolysis of the hydrocarbon-containing feed. The core can be or can include, but is not limited to, silica, alumina, titania, zirconia, magnesia, pumice, ash, clay, diatomaceous earth, bauxite, spent fluidized catalytic cracker catalyst, or any mixture or combination thereof. Preferred support materials can be or can include $Al_2O_3$, $ZrO_2$, $SiO_2$, and combinations thereof, more preferably, $SiO_2$, $Al_2O_3$, or $SiO_2/Al_2O_3$.

In certain embodiments, the transition metal element and/or the oxide thereof can be disposed on and/or within, e.g., within pores, of the core. In certain embodiments, the transition metal element and/or the oxide thereof can form a surface layer on the core. The surface layer on the core can be continues or discontinuous.

The core and/or the particles that include the at least one transition metal element and/or at least one oxidized transition metal element disposed on and/or in the core can have an average size in a range from 10 micrometers (μm), 15 μm, 25 μm, 50 μm, or 75 μm to 150 μm, 200 μm, 300 μm, 400 μm. The core and/or the particles that include the at least one transition metal element and/or at least one oxidized transition metal element disposed on and/or in the core can have a surface area in a range from 10 $m^2/g$, 50 $m^2/g$, or 100 $m^2/g$ to 200 $m^2/g$, 500 $m^2/g$, or 700 $m^2/g$.

In certain embodiments, the fluidized particles can be, can include, or can otherwise be derived from spent fluid catalytic converter ("FCC") catalyst. As such, a significant and highly advantageous use for spent FCC catalyst has been discovered because the processes disclosed herein can significantly extend the useful life of FCC catalyst in upgrading hydrocarbons long after the FCC catalyst is considered to be spent and no longer useful in the fluid catalytic cracking process.

The plurality of fluidized particles can include any oxide of a transition metal element capable of converting at least a portion of any hydrogen to water, e.g., via oxidation, combustion, or other mechanism, within the pyrolysis reaction zone. In certain embodiments, the transition metal element can be or can include, but is not limited to, titanium, vanadium, chromium, manganese, iron, cobalt, niobium, nickel, molybdenum, tantalum, tungsten, alloys thereof, and mixtures thereof. In certain embodiments, the transition metal element can be or can include vanadium, nickel, an alloy thereof, or a mixture thereof.

The amount of transition metal element disposed on and/or at least partially within the plurality of fluidized particles can be in a range from 500 wppm, 750 wppm, 1,000 wppm, 2,500 wppm, 5,000 wppm, or 1 wt % to 2 wt %, 5 wt %, 10 wt %, 15 wt %, 20 wt %, 30 wt %, 40 wt %, or 50 wt %, based on a total weight of the particles. In certain embodiments, the amount of transition metal element disposed on and/or at least partially within the plurality of fluidized particles can be at least 1 wt %, at least 2.5 wt %, at least 3 wt %, at least 3.5 wt %, at least 4 wt %, at least 4.5 wt %, at least 5 wt %, or at least 10 wt % up to 15 wt %, 20 wt %, 30 wt %, 40 wt %, or 50 wt %.

Depositing Transition Metal Element on the Particles

It has been surprisingly and unexpectedly discovered that the process conditions within the pyrolysis reaction zone and/or the first quenching zone can be sufficient to cause at least a portion of any transition metal, if present in the hydrocarbon-containing feed, to deposit, condense, adhere, or otherwise become disposed on the surface of the particles and/or at least partially within the particles. During contact of the hydrocarbon-containing feed and/or the first quenching stream with the plurality of particles within the pyrolysis reaction zone, additional transition metal element can become disposed on the plurality of particles. The additional transition metal element can be the same or different than the transition metal element already disposed on the plurality of particles. As such, the particles fed into the pyrolysis reaction zone can include an oxide of a first transition metal disposed on and/or in the particles and the particles discharged from the pyrolysis reaction zone as a component of the first pyrolysis effluent can include the oxide of the first transition metal element and a second transition metal element and/or an oxide of the second transition metal element disposed on and/or in the particles. At least a portion of the oxide of the first transition metal element in the first pyrolysis effluent can be in a reduced state relative to the oxide of a first transition metal disposed on and/or in the particles when fed into the pyrolysis reaction zone.

In certain embodiments, the first transition metal element can be or can include, but is not limited to, titanium, vanadium, chromium, manganese, iron, cobalt, niobium, nickel, molybdenum, tantalum, tungsten, alloys thereof, and mixtures thereof and the second transition metal element can be or can include, but is not limited to, titanium, vanadium, chromium, manganese, iron, cobalt, niobium, nickel, molybdenum, tantalum, tungsten, alloys thereof, and mixtures thereof. In certain embodiments, the first transition metal element and the second transition metal element can be the same. In certain other embodiments, the first transition metal element and the second transition metal element can be different.

In certain embodiments, the fluidized particles can be or can include inert cores without any transition metal element or oxide thereof disposed on and/or in the inert cores. In certain other embodiments, the fluidized particles can be or can include the inert cores with an undesirably low amount of transition metal element or oxide thereof disposed on and/or in the inert cores. These inert cores free of or containing less than the desired amount of transition metal element or oxide thereof disposed on and/or in the inert cores can be referred to as "starter particles". In certain embodiments, at least a portion of the starter particles can be derived from a fluid catalytic converter catalyst.

A plurality of the starter particles and a source material for the transition metal element can be fed into the pyrolysis reaction zone. The starter particles can be contacted with the source material for the transition metal element in the pyrolysis reaction zone and the first quenching zone to obtain a contacting mixture effluent that can include the starter particles having a layer of the source material for the transition metal element deposited thereon. At least a portion of the starter particles having the layer of the source material for the transition metal element can be heated and oxidized in the combustion zone to form the particles that can include the oxide of the transition metal element. The source material for the transition metal element can be or can include, but is not limited to, the hydrocarbon-containing feed, a feed containing the desired transition metal(s) and a carrier fluid, e.g., fine particles of the transition metal element and/or fine particles of an oxide of the transition metal element and a hydrocarbon as the carrier fluid. In certain embodiments, the amount of transition metal element and/or oxide thereof that can be deposited on and/or in the starter particles to form the particles that can include the transition metal element and/or the oxide of the transition metal element in an amount of 1 wt %, 2 wt %, 3 wt %, 4 wt %, 5 wt %, or 6 wt % to 10 wt %, 12 wt %, 14 wt %, 18 wt %, 20 wt %, or 25 wt %.

In certain embodiments, the particles can be fabricated from a transition metal element-containing material, e.g., a physical mixture of a transition metal oxide and a binder such as clay, which can result in the distribution of the transition metal element throughout the particles. In certain other embodiments, the particles can be fabricated from transition metal element-free support particles, followed by impregnation of the support particles with a transition metal compound solution, followed by drying and calcination, which can result in the distribution of the transition metal element throughout the particles if the support particles are porous or a distribution of the transition metal element in a surface layer if the support particles are non-porous. In certain other embodiments, as discussed above, transition metal element-free support particles can be charged into the pyrolysis zone and contacted with a transition metal element-containing in the hydrocarbon-containing feed or a feed containing the desired transition metal element(s) and a carrier fluid to form transition metal element-containing particles in situ, which can result in the distribution of the transition metal element throughout the particles if the support particles are porous or a distribution or the transition metal element in a surface layer if the support particles are non-porous.

Processing the First Pyrolysis Effluent or the Second Pyrolysis Effluent

A first hydrocarbon stream rich in hydrocarbons and a first particle stream rich in the particles can be recovered or otherwise obtained from the pyrolysis effluent (e.g., where the first pyrolysis effluent is not subjected to contacting with the first organic material contained in the first quenching stream in the first quenching zone) and/or the second pyrolysis effluent (e.g., where the first pyrolysis effluent is subjected to contacting with the first organic material contained in the first quenching stream). For example, the pyrolysis effluent (i.e., the first pyrolysis effluent without intermediate quenching by the first quenching stream, or the second pyrolysis effluent, as the case may be) can be fed from the pyrolysis reaction zone into a first separation vessel configured or adapted to receive the pyrolysis effluent and separate the first hydrocarbon stream rich in hydrocarbons and the first particle stream rich in particles from the pyrolysis effluent. The first separation vessel can be configured or adapted to discharge the first hydrocarbon stream and the first particle stream therefrom.

In certain embodiments, at least a portion of the particles in the pyrolysis effluent (i.e., the first pyrolysis effluent without intermediate quenching by the first quenching stream, or the second pyrolysis effluent, as the case may be) can optionally be stripped by contacting the particles in the pyrolysis effluent with a first stripping medium within the first separation vessel. For example, the pyrolysis effluent can be fed into the first separation vessel, which can be configured or adapted to contact the pyrolysis effluent or at least at portion of the particles in the pyrolysis effluent with a first stripping medium, e.g., a steam stream, and separate the pyrolysis effluent to obtain the first hydrocarbon stream rich in hydrocarbons and rich in the optional first stripping medium and the first particle stream rich in particles. As such, in certain embodiments the first separation vessel can also be referred to a stripping vessel. In certain embodiments, a residence time of the particles in the pyrolysis effluent separated within the first separation vessel from the pyrolysis effluent can be in a range from 30 seconds, 1 minute, 3 minutes, 5 minutes, or 10 minutes to 15 minutes, 17 minutes, 20 minutes, or 25 minutes before being discharged therefrom as the first particle stream rich in particles.

In certain embodiments, the first separation vessel can include an inertial separator configured to separate a majority of the particles from the hydrocarbons to produce the first hydrocarbon stream rich in hydrocarbons and the first particle stream rich in the particles. Inertial separators can be configured or adapted to concentrate or collect the particles by changing a direction of motion of the pyrolysis effluent such that the particle trajectories cross over the hydrocarbon gas streamlines and the particles are either concentrated into a small part of the gas flow or are separated by impingement onto a surface. In certain embodiments, a suitable inertial separator can include a cyclone. The pyrolysis effluent, when introduced into a cyclone can undergo a vortex motion so that the hydrocarbon gas acceleration is centripetal and the particles, therefore, move centrifugally towards the outside of the cyclone, i.e., an inner surface of the cyclone. Illustrative cyclones can include, but are not limited to, those disclosed in U.S. Pat. Nos. 7,090,081; 7,309,383; and 9,358,516.

In certain embodiments, the optional first stripping medium, e.g., steam, can fed into the first separation vessel. In certain embodiments, the optional first stripping medium can fed into the first separation vessel at a weight ratio of the first stripping medium to the pyrolysis effluent fed into the first separation vessel in a range from 1:1,000, 2:1,000, or 2.5:1,000, or 3:1,000 to 4:1,000, 6:1,000, 8:1,000, or 10:1,000.

In certain embodiments, a residence time within the separation vessel of the hydrocarbons in the pyrolysis effluent separated from the pyrolysis effluent can be less than 1,000 ms, less than 750 ms, less than 500 ms, less than 250 ms, less than 100 ms, less than 75 ms, less than 50 ms, or less than 25 ms. In certain embodiments, a residence time within the separation vessel of the hydrocarbons in the pyrolysis effluent separated from the pyrolysis effluent can be in a range from 2 ms, 4 ms, 6 ms, or 8 ms to 10 ms, 12 ms, 14 ms, 16 ms, 18 ms, or 20 ms before being discharged therefrom as the first hydrocarbon stream. In certain embodiments, the residence time within the separation vessel of the hydrocarbons in the pyrolysis effluent separated within from the pyrolysis effluent can be less than 20 ms, less than 15 ms, less than 10 ms, less than 7 ms, less than 5 ms, or less than 3 ms before being discharged therefrom as the first hydrocarbon stream. The first hydrocarbon stream rich in hydrocarbons, upon being discharged from the first separation vessel, can be free or substantially free of any particles. In certain embodiments, the first hydrocarbon stream discharged from the first separation vessel can include less than 25 wt %, less than 20 wt %, less than 15 wt %, less than 12 wt %, less than 10 wt %, less than 8 wt %, less than 6 wt %, less than 5 wt %, less than 3 wt %, or less than 1 wt % of the particles present in the pyrolysis effluent.

In certain embodiments, a residence time of the hydrocarbons in the first hydrocarbon stream separated from the pyrolysis effluent spanning from the initial introduction of the hydrocarbon-containing feed and fluidized particles into the pyrolysis zone to the recovery of the first hydrocarbon stream rich in hydrocarbons from the first separation vessel can be 5 ms, 10 ms, 25 ms, 50 ms, 75 ms, or 100 ms to 300 ms, 500 ms, 750 ms, 1,000 ms, 1,250 ms, 1,500 ms, 1,750 ms, or 2,000 ms. In certain other embodiments, residence time of the hydrocarbons in the first hydrocarbon stream separated from the pyrolysis effluent spanning from the initial introduction of the hydrocarbon-containing feed and fluidized particles into the pyrolysis zone to the recovery of the first hydrocarbon stream rich in hydrocarbons from the first separation vessel can be less than 1,500 ms, less than 1,250 ms, less than 1,000 ms, less than 800 ms, less than 600 ms, less than 400 ms, less than 300 ms, less than 200 ms, less than 150 ms, or less than 100 ms.

Processing the First Hydrocarbon Stream

The first hydrocarbon stream rich in hydrocarbons and optionally the first stripping medium can be at a temperature in a range from 700° C., 750° C., 800° C., 850° C., 900° C., to 950° C., 1,000° C., 1,100° C., or 1,200° C. upon discharge from the first separation vessel. As such, it can be desirable that the first hydrocarbon stream be cooled as quickly as possible after discharging from the first separation vessel, to a sufficiently low temperature in a very short period of time reduce or minimize reactive species from recombining to form larger molecules and/or such that the olefins do not become saturated to form alkanes during the cooling process. The first hydrocarbon stream can be cooled to a temperature of less than 750° C., less than 700° C., less than 650° C., less than 600° C., less than 550° C., less than 500° C., less than 450° C., or less than 400° C. In certain embodiments, the first hydrocarbon stream can be cooled to a temperature of in a range from 250° C., 300° C., 350° C., 400° C., 450° C., or 500° C. to less than 700° C., less than 675° C., less than 650° C., less than 625° C., less than 600° C., less than 550° C., or less than 500° C. In certain embodiments, the first hydrocarbon stream can be cooled from the temperature upon discharge from the first separation vessel to the temperature of the cooled first hydrocarbon stream in a range from 1 ms, 3 ms, 5 ms, or 7 ms to 10 ms, 12 ms, 15 ms, or 20 ms. In certain other embodiments, the first hydrocarbon stream can be cooled from the temperature upon discharge from the first separation vessel to the temperature of the cooled first hydrocarbon stream in less than 20 ms, less than 15 ms, less than 10 ms, less than 7 ms, less than 5 ms, less than 4 ms, less than 3 ms, less than 2 ms, or less than 1 ms.

In certain embodiments, a preferred process for cooling the first hydrocarbon stream can include indirectly exchanging heat from the first hydrocarbon stream to a quenching medium, e.g., water (liquid or gaseous), quenching oil, or other fluid to produce a cooled first hydrocarbon stream. Suitable heat exchangers can be or can include, but are not limited to, shell-and-tube heat exchanger, a plate and frame heat exchanger, brazed aluminum heat exchangers, a plate and fin heat exchanger, a spiral wound heat exchanger, a coil wound heat exchanger, a U-tube heat exchanger, a bayonet style heat exchanger, any other apparatus, or any combination thereof.

In certain other embodiments, a preferred process for cooling the first hydrocarbon stream can include injecting a quenching medium, e.g., a quenching oil, into the first hydrocarbon stream in a second quenching section downstream, e.g., a transfer line exchanger ("TLE"), of the first separation vessel to produce the cooled first hydrocarbon stream. In another embodiment, the first hydrocarbon stream can be cooled by indirectly exchanging heat and by contacting with a quenching medium. In certain embodiments, the first hydrocarbon stream can have a temperature in a range from 700° C., 850° C., or 900° C. to 950° C., 1,000°

C., 1,100° C., or 1,200° C. when initially contacted with the quenching medium or when heat is initially transferred from the first hydrocarbon stream to a heat transfer medium in a heat exchanger.

Any suitable quenching medium(s) having a temperature and/or heat capacity capable of reducing the temperature of the first hydrocarbon stream to a desirable level via direct contact and/or indirect contact can be used. In certain embodiments, the quenching medium can be or can include, but is not limited to, water, a quench oil, a gas oil, naphtha, a stream rich in paraffins, or the like. In certain embodiments, the quench medium can be or can include a recycled quench oil, a recycled gas oil, a recycled naphtha, a recycle stream rich in paraffins, or the like separated from the first hydrocarbon stream in a downstream separation process.

In a preferred embodiment, the quenching medium can be or can include a stream of quenching oil separated from the first hydrocarbon stream in a downstream distillation column. In a more preferred embodiment, at least a portion of a stream rich in paraffins separated from the first hydrocarbon stream in a downstream separation system, e.g., a recovery sub-system, can be injected into the first hydrocarbon stream in the quenching section to combine with the first hydrocarbon stream to form a mixture having a temperature substantially lower than the first hydrocarbon stream upon being discharged from the first separation vessel.

It has been discovered that the first hydrocarbon stream upon being discharged from the first separation vessel can be at a temperature sufficient to effect pyrolysis of at least a portion of the hydrocarbons in the quench medium. As such, by utilizing a quenching medium that includes paraffins, the amount of olefins in the cooled or quenched first hydrocarbon steam can be increased relative to the first hydrocarbon stream upon being discharged from the first separation reactor.

In certain embodiments, the first hydrocarbon stream can be contacted with a quench medium that includes one or more paraffins, e.g., ethane, propane, butane, pentane, hexane, or a mixture thereof. Such quench medium can be referred to as a stream rich in paraffins. By quenching the first hydrocarbon stream with a quench medium that includes one or more paraffins the amount of C4-olefins in the quenched first hydrocarbon stream can be increased relative to the amount of C4-olefins in the first hydrocarbon stream recovered from the first separation vessel because at least a portion of the paraffins can be cracked to produce additional olefins.

The time from contacting at least a portion of the hydrocarbon-containing feed with the particles in the pyrolysis reaction zone to indirectly exchanging heat to a quenching medium and/or contacting the first hydrocarbon stream with a quenching medium can be in a range from 10 ms, 25 ms, 50 ms, 75 ms, or 100 ms to 300 ms, 500 ms, 750 ms, 1,000 ms, 1,250 ms, 1,500 ms, 1,750 ms, or 2,000 ms. In certain embodiments, the time from contacting at least a portion of the hydrocarbon-containing feed with the particles in the pyrolysis reaction zone to indirectly exchanging heat to the quenching medium and/or contacting the first hydrocarbon stream with the quenching medium can be less than 2,000 ms, less than 1,500 ms, less than 1,000 ms, less than 800 ms, less than 600 ms, less than 400 ms, less than 200 ms, less than 150 ms, less than 100 ms, less than 75 ms, or less than 50 ms.

The cooled first hydrocarbon stream can include, but is not limited to, one or more of the following: hydrogen, methane, ethane, ethylene, propane, propylene, butenes, naphtha, gas oil, a heavy oil, and tar. The naphtha, gas oil, heavy oil, and tar each include a mixture of compounds, primarily a mixture of hydrocarbon compounds. It should be understood that typically there is an overlap between naphtha and gas oil, an overlap between gas oil and heavy oil or quench oil, and an overlap between heavy oil and tar in composition and boiling point range. Naphtha, also referred to as pygas, is a complex mixture of $C_{5+}$ hydrocarbons, e.g., $C_5$-$C_{10+}$ hydrocarbons, having an initial atmospheric boiling point of 25° C. to 50° C. and a final boiling point of 220° C. to 265° C., as measured according to ASTM D2887-18. In certain embodiments, naphtha can have an initial atmospheric boiling point of 33° C. to 43° C. and a final atmospheric boiling point of 234° C. to 244° C., as measured according to ASTM D2887-18. The final atmospheric boiling point of the gas oil is typically 275° C. to 285° C., as measured according to ASTM D2887-18. The final atmospheric boiling point of the heavy oil or quench oil is typically 455° C. to 475° C., as measured according to ASTM D2887-18. In certain embodiments, the tar product can have an initial boiling point of at least 200° C. and/or a final atmospheric boiling point of >600° C., as measured according to ASTM D2887-18.

The cooled first hydrocarbon stream can be separated to obtain a second hydrocarbon stream rich in hydrocarbons and a third particle stream rich in the particles. In certain embodiments, separating the cooled first hydrocarbon stream can include using a cyclone. For example, the cooled first hydrocarbon stream can be fed into a third separation vessel configured or adapted to receive the cooled first hydrocarbon stream and separate the second hydrocarbon stream rich in hydrocarbons and the third particle stream rich in particles therefrom. The third separation vessel can be configured or adapted to discharge the second hydrocarbon stream and the third particle stream therefrom.

In certain embodiments, the particles in the cooled first hydrocarbon stream can optionally be stripped by contacting at least a portion of the particles in the cooled first hydrocarbon stream with a third stripping medium within the third separation vessel. For example, the cooled first hydrocarbon stream can be fed into the third separation vessel, which can be configured or adapted to contact at least a portion of the particles in the cooled first hydrocarbon stream with the third stripping medium, e.g., a steam stream, to obtain the second hydrocarbon stream rich in hydrocarbons and rich in the optional third stripping medium and the third particle stream rich in the particles. As such, in certain embodiments, the third separation vessel can also be referred to as a stripping vessel or as including a stripping zone or stripping vessel. In certain embodiments, the third separation vessel can be or can include one or more multi-cyclone (multiclone) separators. In certain embodiments, the third separation vessel can include the conventional separators are available from several vendors, such as the Polutrol, Shell and Emtrol, such as the Polutrol TSS and the Emtrol Cytrol TSS.

The second hydrocarbon stream rich in hydrocarbons can include less than 1 wt %, less than 0.7 wt %, less than 0.5 wt %, less than 0.3 wt %, or less than 0.1 wt % of any particles. In certain embodiments, at least a portion of the third particle stream can rich in the particles can be introduced into the first separation vessel, e.g., a stripping zone within the first separation vessel. In certain other embodiments, at least a portion of the third particle stream rich in particles can be recycled to the combustion zone. In certain embodiments, at least a portion of the third particle stream can be removed from the process. In certain embodiments, a first portion of the third particle stream can be introduced into the first separation vessel and/or recycled to the combustion zone and a second portion of the third particle stream can be removed from the process.

The second hydrocarbon stream rich in hydrocarbons can be further cooled, e.g., indirect heat exchange with a heat transfer medium, quenching with a quench medium, e.g., a portion of the heavy oil or other stream(s) separated from the second hydrocarbon stream via one or more downstream separation processes, water, or the like.

The second hydrocarbon stream or the further cooled second hydrocarbon stream can be separated to obtain two or more products therefrom. In certain embodiments, the second hydrocarbon stream can be separated within a fractionation zone to obtain a bottoms heavy stream, a gas oil stream, and an overhead stream rich in naphtha and light hydrocarbons. The overhead stream can be further separated to obtain a naphtha stream, at least one olefin stream rich in one or more olefins, and at least one hydrogen stream rich in hydrogen. In certain embodiments, the overhead stream can also be separated to obtain the stream rich in paraffins, which, as discussed above, can be used as at least a portion of the quench medium contacted with the first hydrocarbon stream to produce the quenched first hydrocarbon stream.

In certain embodiments, at least a portion of the gas oil stream can be used as the quenching medium that can contact the first hydrocarbon stream rich in hydrocarbons to produce the quenched first hydrocarbon stream. In certain embodiments, a first portion of the gas oil stream can be used as the quenching medium and a second portion can be removed from the process.

In certain embodiments, the bottoms heavy stream can be cooled in one or more heat exchanges by indirectly exchanging heat to a heat transfer medium, e.g., boiler feed water, to produce a cooled bottoms heavy stream and a pre-heated boiler feed water. The preheated boiler feed water can be used to cool the second hydrocarbon stream rich in hydrocarbons by indirectly exchanging heat.

In certain embodiments, a portion or first portion of the cooled bottoms heavy stream can be contacted with the second hydrocarbon steam rich in hydrocarbons or the cooled second hydrocarbon stream rich in hydrocarbons as a quench medium. In certain embodiments a portion or second portion of the cooled bottoms heavy stream can be fed into the combustion zone as the fuel or as at least a portion of the fuel that can optionally be fed thereto.

In certain embodiments, especially those in which the step of contacting the first pyrolysis effluent with the first organic-material-containing stream is carried out, particularly those in which the first organic-material-containing stream comprises a waste material, such as a contaminated waste material, the first hydrocarbon stream and/or the second hydrocarbon carbon stream may comprise certain contaminants at various concentrations. For example, where the first organic-material-containing stream comprises a waste material comprising a halide (e.g., polyvinyl chloride), hydrogen halide (e.g., HCl) may be produced from the process and be present in the first hydrocarbon stream and/or the second hydrocarbon stream, which can cause undesirable equipment corrosion. For another example, where the first organic-material-containing stream comprises mercury, elemental mercury or a mercury compound may be present in the first hydrocarbon stream and/or the second hydrocarbon stream, which can be harmful if released into the environment directly. In such embodiments, any processes and equipment known in the art for abating hydrogen halide and/or mercury may be used to treat the first hydrocarbon stream and/or the second hydrocarbon stream where appropriate. Abating of HCl can be achieved by, e.g., washing the stream using an alkaline solution (e.g., NaOH aqueous solution). Abating of mercury can be achieved by, e.g., contacting a mercury absorbent/adsorbent such as active carbon, and the like.

Processing the First Particle Stream

Returning to the first particle stream rich in particles, at least a portion of the particles in the first particle stream can be fed into the combustion zone. An oxidant or oxidizing agent and optionally a fuel can be fed into the combustion zone in addition to the first particle stream rich in particles. In certain embodiments, the oxidizing agent can be or can include molecular oxygen. In certain embodiments, the oxidizing agent can be or can include air, oxygen enriched air, oxygen depleted air, or any mixture thereof. The fuel can be or can include any combustible source of material capable of combusting in the presence of the oxidizing agent within the pyrolysis reaction zone. Suitable fuels can be or can include, but are not limited to, naphtha, gas oil, fuel oil, quench oil, fuel gas, molecular hydrogen, or any mixture thereof. In certain embodiments, the fuel can be or can include a bottoms heavy oil stream separated from the first hydrocarbon stream. The combustion zone effluent, which can include heated and optionally oxidized particles and a flue gas, can be obtained from the combustion zone.

The first particle stream rich in particles fed into the combustion zone can be heated and optionally oxidized at a temperature in a range from 800° C., 900° C., or 1,000° C. to 1,100° C., 1,200° C., or 1,300° C. In certain embodiments, an amount of the optional fuel that can be introduced into the combustion zone can be sufficient to provide additional heat within the combustion zone to produce the combustion zone effluent that includes the heated and oxidized particles at the desired temperature.

In certain embodiments, when the first particle stream rich in particles includes coke disposed on and/or at least partially in the particles and/r the first particle stream comprises a plurality of coke particles, at least a portion of the coke contained in and/or on the particles can be combusted within the combustion zone. The combustion of the deposited coke, coke particles, and/or the optional fuel supplied to the combustion zone is highly exothermic, raising the temperature of the particles contained therein to an elevated temperature. The heated and optionally oxidized particles in the combustion zone effluent obtained from the combustion zone can include less coke as compared to the particles in the first particle stream rich in particles or can be free of any coke. In certain embodiments, the particles in the combustion zone effluent can include less than 5 wt %, less than 4 wt %, less than 3 wt %, less than 2 wt %, less than 1 wt %, less than 0.5 wt %, or less than 0.1 wt % of coke.

Without wishing to be bound by theory, it is believed that for a transition metal element that has multiple valences, the transition metal element when at a high oxidative state may be less selective toward oxidation of molecular hydrogen as compared to the transition metal element when at a lower oxidative state. As such, in certain embodiments, an amount of oxidant or oxidizing agent fed into the combustion zone can be controlled or otherwise adjusted to produce the combustion zone effluent that includes the transition metal element at a desired or predetermined oxidized state. As such, in certain embodiments, the combustion zone can be operated under complete combustion conditions that can produce a combustion zone effluent that includes a flue gas that can contain at least a portion of the oxidizing agent fed into the combustion zone, e.g., 0.5 mol % to 2.5 mol % or 1 mol % to 2 mol % of the oxidizing agent, and a low concentration of carbon monoxide, e.g., less than 1 mol % of carbon dioxide. In certain other embodiments, the combustion zone can be operated under partial combustion conditions that can produce a combustion zone effluent that includes a flue gas that can contain at least 1 mol % of carbon monoxide and less than 0.5 mol %, e.g., 0 mol %, of the oxidizing agent. The flue gas produced during partial combustion can be free or substantially free of any of the oxidizing agent introduced into the combustion zone. Accordingly, the combustion zone can be operated under conditions sufficient to cause at least a portion of the transition metal element in the particles to be oxidized to a higher oxidation state as compared to the transition metal element in the particles in the pyrolysis effluent, but not necessarily oxidized to the highest oxidation state possible for a given transition metal element.

At least a portion of the heated and optionally oxidized particles in the combustion zone effluent can be supplied to the pyrolysis reaction zone directly as at least a portion of the plurality of fluidized particles fed to the pyrolysis reaction zone. In some embodiments, the combustion zone effluent can under go one or more optional treatments before feeding at least a portion of the oxidized and heated particles to the pyrolysis reaction zone.

In certain embodiments, the combustion zone effluent can contact a second organic-material-containing stream in a gasifying zone downstream (preferably immediately downstream) of the combustion zone. The second organic material can preferably comprise, consist essentially of, or consist of a waste stream produced or derived from a petroleum refinery and/or a chemical plant. Non-limiting examples of such waste stream are: tank bottom streams; steam cracker tar; fluid catalytic cracker tar; lube extract, heavy aromatic hydrocarbons, fuel oils, bio-oils, and the like. Preferably the second organic-material-containing stream comprises hydrogen (as an element) of ≥10 wt %, preferably ≥15 wt %, preferably ≥20 wt %, preferably ≥25 wt %, preferably ≥30 wt %, based on the total weight of the second organic-material-containing stream. A relatively high hydrogen content of the second organic-material-containing stream is desirable for producing syngas with a high content of molecular hydrogen. The second organic-material-containing stream can comprise, in addition to the second organic material, steam, which can be derived from the waste stream itself, or added separately where appropriate. The very high temperature of the particles in the combustion zone effluent, on contacting the second organic material can cause the cracking thereof and the production of molecular hydrogen and carbon monoxide (CO) according to the following general reaction:

$$\text{Hydrocarbons}+H_2O \rightarrow H_2+CO$$

The gas/particles mixture exiting the gasifying zone therefore can be rich in both molecular hydrogen and CO, which, if separated as a mixture forms syngas useful in many chemical processes, e.g., the Fischer-Tropsh processes for making longer-chain hydrocarbons.

The combustion zone effluent and/or the gasifying zone effluent can optionally be separated into a second particle stream that can be rich in the heated and oxidized particles and a first flue gas stream that can be rich in flue gas. For example, the combustion zone effluent can be discharged from the combustion zone into a second separation vessel configured or adapted to receive the combustion zone effluent and/or the gasifying zone effluent and separate the second particle stream and the flue gas therefrom. The second separation vessel can be configured or adapted to discharge the second particle stream and the first flue gas therefrom. The second particle stream can be recycled or otherwise fed into the pyrolysis reaction zone as at least a portion of the particles fed into the pyrolysis reaction zone.

In certain embodiments, the combustion zone effluent and/or the gasifying zone effluent can optionally be stripped by contacting the combustion zone effluent within the second separation vessel with a second stripping medium. For example, the combustion effluent and/or the gasifying zone effluent can be fed from the combustion zone or the gasifying zone into the second separation vessel, which can be configured or adapted to contact the combustion zone effluent or the gasifying zone effluent with a second stripping medium, e.g., a steam stream, and separate the combustion zone effluent or the gasifying zone effluent to obtain the second particle stream rich in particles and the first flue gas stream rich in the optional second stripping medium stream. As such, the second separation vessel can also be referred to a stripping vessel.

The first flue gas stream can be at a temperature in a range of 800° C., 900° C., or 1,000° C., to 1,100° C., 1,200° C., or 1,300° C. In certain embodiments, the first flue gas stream can be quenched by contacting the first flue gas stream with a quenching medium to produce a quenched first flue gas stream. In certain embodiments, the quenching medium contacted with the first flue gas stream can be or can include, but is not limited to, air, water (liquid or gaseous), or a mixture thereof.

The first flue gas stream or the quenched first flue gas stream can be separated to obtain a second flue gas stream rich in flue gas and a fourth particle stream rich in particles. In certain embodiments, separating the first flue gas stream or the quenched first flue gas stream can include using a cyclone. For example, the first flue gas stream or the quenched first flue gas stream can be fed into a fourth separation vessel configured or adapted to receive the first flue gas stream or the quenched first flue gas stream and separate the second flue gas stream and the fourth particle stream therefrom. The fourth separation vessel can be configured or adapted to discharge the second flue gas stream and the fourth particle stream.

In certain embodiments, at least a portion of the particles in the first flue gas stream or the quenched first flue gas stream can optionally be stripped by contacting at least a portion of the particles with a fourth stripping medium within the fourth separation vessel. For example, the first flue gas stream or the quenched first flue gas stream can be fed into the fourth separation vessel, which can be configured or adapted to contact at least a portion of the particles with the fourth stripping medium, e.g., a steam stream, to obtain the second flue gas stream rich in flue gas and rich in the optional fourth stripping medium and the fourth particle stream rich in particles. As such, the fourth separation vessel can also be referred to a stripping vessel. If the first flue gas stream or the quenched first flue gas stream is operated at pressure (e.g., having an absolute pressure of ≥200 kilopascal), the flue gas may be preferentially sent to an expander to recovery the energy.

If the first flue gas stream is quenched, the first flue gas stream can be at a temperature sufficiently low, e.g., 875° C. or less, to enable the third separation vessel to be constructed of low-temperature metallurgy. In certain embodiments, the fourth separation vessel can be or can include one or more multi-cyclone (multi-clone) separators. In certain embodiments, the fourth separation vessel can include the conventional separators are available from several vendors, such as the Polutrol, Shell and Emtrol, such as the Polutrol TSS and the Emtrol Cytrol TSS.

The second flue gas stream can be used to indirectly heat one or more process streams. In certain embodiments, the second flue gas stream can be used to indirectly heat the oxidant or oxidizing agent prior to feeding the oxidizing agent into the combustion zone. The second flue gas stream can also be used to indirectly heat the hydrocarbon-containing feed prior to feeding the hydrocarbon-containing feed into the pyrolysis reaction zone. The second flue gas stream can also be used to indirectly heat boiler feed water to produce steam. The steam can be used as stripping steam, a motive fluid, e.g., to fluidize the particles fed to the pyrolysis reaction zone and/or to fluidize the first particle stream rich in particles, as the optional steam that can be fed into the pyrolysis reaction zone, or any other use that could utilize the steam.

The second flue gas stream can be used to indirectly heat any two or more process streams in a serial flow arrangement. For example, the second flue gas stream can be used to indirectly heat the oxidizing agent and produce a first cooled second flue gas, the first cooled second flue gas can be used to indirectly heat the hydrocarbon-containing feed and produce a second cooled second flue gas, and the second cooled second flue gas can be used to indirectly heat the boiler feed water to produce steam and a third cooled second flue gas. In another embodiment, a first portion of the second flu gas can be used to heat the oxidizing agent, a second portion of the second flue gas can be used to heat the hydrocarbon-containing feed, and a third portion of the second flue gas can be used to heat the boiler feed water. The second flue gas or the cooled second flue gas can be further treated if needed to remove any sulfur oxide or other contaminants prior to venting the atmosphere or otherwise disposing of.

The first and/or the second flue gas stream can be rich in molecular hydrogen and CO, as discussed above, especially where the second organic-material-containing stream is fed to the gasifying zone to contact the high-temperature combustion zone effluent. A mixture of molecular hydrogen and CO can be separated from the first and/or second flue gas stream as a syngas product, which can be converted into useful products such as alkanes via, e.g., Fischer-Tropsh reactions.

Where the second organic-material-containing stream comprises elements less than environmentally friendly such as nitrogen, sulfur, halides, tin, mercury, and the like, such elements may be entrained in the first flue gas and/or the second flue gas as undesirable oxides (NOx, e.g.) and other compounds. The first flue gas and/or the second flue gas stream may be processed to abate those elements using processes, equipment, and technologies available in the art.

In certain embodiments, at least a portion of the fourth particle stream rich in particles can be recycled to the combustion zone. In certain embodiments, at least a portion of the fourth particle stream can be removed from the process. In certain embodiments, a first portion of the fourth particle stream can be recycled to the combustion zone and a second portion of the fourth particle stream can be removed from the process.

Removal and Replacement of the Particles

It has also been discovered that as the amount of transition metal or oxide thereof increases the effectiveness of the particles to facilitate the oxidation and/or combustion of hydrogen can begin to decrease. As such, it can be desirable to remove a portion of the particles from the process when an amount of the transition metal element and/or the oxide thereof increases above a predetermined level. The predetermined amount of the transition metal element and/or the oxide thereof can be in a range from 10 wt %, 12 wt %, or 14 wt % to 16 wt %, 18 wt %, 20 wt %, 22 wt %, or 25 wt %, based on the weight of the particles. In certain embodiments, the particles can be removed from the process at a rate of about 0.1 wt %, about 0.3 wt %, about 0.5 wt %, about 0.7 wt %, or about 1 wt % to about 1.3 wt %, about 1.5 wt %, about 1.7 wt %, about 2 wt %, about 3 wt %, about 5 wt %, about 10 wt % or more per 24 hours, based on the total weight of particles being circulated through the process. In certain embodiments, the particles can be removed from the process at a continuous rate or in batches and replace particles can be introduced into the process at a continuous rate or in batches.

In certain embodiments, a portion of the particles can be removed or obtained from the first particle stream rich in particles, the second particle stream rich in particles, the third particle stream rich in particles, or the fourth particle stream rich in particles. When a portion of the particles is removed from the process replacement particles can be added into the process. For example, the replacement particles can be fed into the combustion zone and/or mixed, blended, or otherwise combined with the hydrocarbon-containing feed and/or any other stream that includes particles such as the first particle stream rich in particles the second particle stream rich in particles, the third particle stream rich in particles, and/or the fourth particle stream rich in particles.

This disclosure is further illustrated by the following non-limiting examples.

Example

In the drawings of this application, like reference numerals have like meanings, mutatis mutandis.

FIG. 1 (Comparative)

FIG. 1 depicts a comparative process/system 100 for processing a hydrocarbon-containing feed in line 102. The system 100 can include, but is not limited to, one or more pyrolysis reactors, e.g., a downflow reactor, 115, one or more first separation vessels 120, one or more combustion vessels 125, one or more second separation vessels 130, and one or more channels 132 configured or adapted to feed a particle stream from second separation vessel 130 to the pyrolysis reactor 115.

In certain embodiments, the first separation vessel 120 can include one or more inertial separators 119 that can be configured to separate a majority of the particles from the gaseous hydrocarbons to provide a first hydrocarbon stream rich in hydrocarbons via line 121 and the particles can fall or otherwise flow toward an end or lower portion of the first separation vessel 120. In certain embodiments, a suitable inertial separator can include a cyclone. The pyrolysis effluent, when introduced into a cyclone can undergo a vortex motion so that the hydrocarbon gas acceleration is centripetal and the particles, therefore, move centrifugally towards the outside of the cyclone, i.e., an inner surface of the cyclone. Illustrative cyclones can include, but are not limited to, those disclosed in U.S. Pat. Nos. 7,090,081; 7,309,383; and 9,358,516.

In certain embodiments, the system 100 can also include one or more first quenching stages or quenching sections 135, one or more third separation vessels 140, and one or more channels two are shown 143, 144 configured or adapted to feed at least a portion of a particle stream from the third separation vessel to the first separation vessel 120 (shown) and/or the combustion vessel 125 (not shown). In certain embodiments, the system 100 can also include one or more heat exchangers 150 and one or more distillation columns 160. In certain embodiments, the system 100 can also include one or more channels 162 and/or 173 configured or adapted to feed a side-draw product and/or an overhead product to the quenching zone 135. In certain embodiments, the system 100 can also include one or more channels (two are shown) 161,166 configured or adapted to feed at least a portion of a bottoms product from the distillation column 160 to the combustor 125. In certain embodiments, the system 100 can also include one or more recovery sub-systems 170. In certain embodiments, the system 100 can also include one or more fourth separation vessels 185 and one or more channels 187 configured or adapted to feed at least a portion of a particle stream from the fourth separation vessel 185 to the combustion vessel 125. In certain embodiments, the system 100 can also include one or more heat exchangers 106 and one or more channels 108 configured or adapted to transfer a flue gas stream from the fourth separation vessel 185 to the heat exchanger 106.

In certain embodiments, an oxidant or an oxidizing agent, e.g., air, via line 101, the hydrocarbon-containing feed via line 102, and water, e.g., boiler feed water, via line 103 can be fed into one or more first heat exchange stages, e.g., a first heat exchanger, 105, one or more second heat exchange stages, e.g., a second heat exchanger, 106, and one or more third heat exchange stages, e.g., a third heat exchanger, 107, respectively. A heat source or heated medium, e.g., a combustion or flue gas, via line 108 can be serially fed into the first heat exchange stage 105, the second heat exchange stage 106, and the third heat exchange stage 107, respectively, thereby transferring heat to the oxidant, the hydrocarbon-containing feed, and the boiler feed water, respectively. A heated oxidizing agent via line 110 and a heated hydrocarbon-containing feed via line 111 can be obtained from the first and second heat exchange stages 105, and 106, respectively. Steam via line 112 and a cooled medium, e.g., water, via line 113 can be obtained from the third heat exchange stage 107.

At least a portion of the hydrocarbon-containing feed via line 111 and a fluidized stream of particles via line 132 can be fed into the pyrolysis reactor 115. The fluidized stream of particles, upon introduction into the pyrolysis reactor 115, can have a first temperature. The hydrocarbon-containing feed can contact the particles within the pyrolysis reactor 115 to effect pyrolysis of at least a portion of the hydrocarbon-containing feed. The first temperature can be sufficiently high to enable the pyrolysis of at least a portion of the hydrocarbon-containing feed. As discussed above, the particles can include an oxide of a transition metal element that can be capable of oxidizing molecular hydrogen ($H_2$) at the first temperature. In certain embodiments, at least a portion of the steam via line 112 can optionally be fed into the pyrolysis reactor 115.

During pyrolysis of the hydrocarbon-containing feed coke can deposit, condense, adhere, or otherwise become disposed on the surface of the particles and/or at least partially within the particles. It has been discovered that when the hydrocarbon-containing feed in line 111 includes one or more transition metal elements, which can be the same or different than the transition metal element already on the particles when fed into the pyrolysis reactor 115, at least a portion of the transition metal element in the hydrocarbon-containing feed can also deposit, condense, adhere, or otherwise become disposed on the surface of the particles and/or at least partially within the particles.

A pyrolysis effluent via outlet 116 can be discharged from the pyrolysis reactor 115 into the first separation vessel 120 configured or adapted to receive and separate the pyrolysis effluent to obtain a first hydrocarbon stream rich in hydrocarbons and a first particle stream rich in the particles. The first hydrocarbon stream rich in hydrocarbons via line 121 and the first particle stream rich in the particles via line 122 can be discharged from the first separation vessel 120.

In certain embodiments, a stripping steam stream or first stripping steam stream via line 118 can optionally be fed into the first separation vessel 120. If the stripping steam stream via line 118 is fed into the first separation vessel 120, the stripping steam stream can improve or otherwise aid in separating the first hydrocarbon stream and the first particle stream from the pyrolysis effluent. If the optional stripping steam stream via line 118 is fed into the first separation vessel 120 the first hydrocarbon stream rich in hydrocarbons discharged via line 121 can also include at least a portion of the steam. In certain embodiments, the first separation vessel 120 can be or can include one or more cyclones configured or adapted to separate the first hydrocarbon stream and the first particle stream from the pyrolysis effluent.

The first particle stream via line 122, the heated oxidizing agent via line 110, and optionally a fuel stream via line 166 can be fed into the combustion vessel 125. In certain embodiments, steam or other motive fluid via line 123 can be mixed, blended, or otherwise combined with the first particle stream in line 122. The fluid fed via line 123 can fluidize the particles within line 122 to urge or otherwise move the particles into the combustion vessel 125. The combustion vessel 125 can be configured or adapted to combust coke deposited onto the particles during pyrolysis of the hydrocarbon-containing feed. When the optional fuel stream via line 166 is fed into the combustion vessel 125, at least a portion of the fuel stream can be combusted. Combustion of the coke disposed on the particles and the option fuel stream within the combustion vessel 125 can produce a combustion zone effluent that can include heated particles, a flue gas, and oxidized particles in which the transition metal element has a higher oxidation state as compared to the transition metal element in the particles in the pyrolysis effluent and the first particle stream rich in the particles in line 122. The combustion vessel 125 can be configured or adapted to discharge the combustion effluent via line 126.

The combustion effluent via line 126 can be fed into the second separation vessel 130 that can be configured or adapted to receive and separate the combustion zone effluent to obtain a second particle stream rich in the particles and a first flue gas stream rich in the flue gas. The first flue gas stream via line 131 and the second particle stream via line 132 can be discharged from the second separation vessel 130. As shown in the FIG., the second particle stream via 132 is recycled or otherwise fed into the pyrolysis reactor 115 as the fluidized stream of particles.

In certain embodiments, a stripping steam stream or second stripping steam stream via line 127 can optionally be fed into the second separation vessel 130. If the steam stream via line 127 is fed into the second separation vessel 130, the steam stream can improve or otherwise aid in separating the flue gas stream and the particles from the combustion effluent. In certain embodiments, the second separation vessel 130 can be or can include one or more cyclones configured or adapted to separate the flue gas and the particles from the combustion effluent.

The first hydrocarbon stream via line 121 and a quench medium via line 162 can be fed into one or more quenching sections, e.g., a transfer line exchanger, 135 configured or adapted to produce a quenched mixture stream that includes the quench medium and the first hydrocarbon stream. The quenched mixture stream can be discharged via line 136 from the quenching section 135. In certain embodiments, the quench medium in line 162 can be or can include a side-draw gas oil stream obtained from the distillation column 160. In certain other embodiments, a stream rich in paraffins via line 173 obtained from the recovery sub-system 170. If the stream rich in paraffins via line 173 is fed into the quenching section 125, the first hydrocarbon steam can be at a temperature sufficiently high to enable pyrolysis of at least a portion of the stream rich in paraffins upon contacting with the first hydrocarbon stream.

The quenched mixture stream via line 136 can be fed into the third separation vessel 140 configured or adapted to receive and separate the quenched mixture stream to obtain a second hydrocarbon stream rich in hydrocarbons and a third particle stream rich in the particles. In certain embodiments, the third separation vessel 140 can be or can include one or more cyclones 141 (two are shown) configured or adapted to separate the quenched mixture stream to obtain the second hydrocarbon stream and the third particle stream. In certain other embodiments, a stripping steam stream or third stripping steam stream (not shown) can be fed into the third separation vessel 140. If the stripping steam stream is fed into the third separation vessel 140, the stripping steam stream can improve or otherwise aid in separating the second hydrocarbon stream and the third particle stream from the quenched mixture stream.

The second hydrocarbon stream via line 142 and the third particle stream via line 143 can be discharged from the third separation vessel 140. In certain embodiments, at least a portion of the third particle stream in line 143 can be fed via line 144 into the first separation vessel 120. Feeding the third particle stream via line 144 into the first separation vessel can at least partially cool the pyrolysis effluent fed via the outlet 116 of the pyrolysis reactor 115. In certain other embodiments, at least a portion of the third particle stream in line 143 can be fed via line 144 into the combustion vessel 125 (not shown). In certain other embodiments, at least a portion of the third particle stream in line 143 can be removed via line 145 from the system 100. The removal of at least a portion of the third particle stream via line 145 can be used to control or adjust an amount of particles in the system that during operation can become undesirably rich in the transition metal element disposed thereon. In certain embodiments, when at least a portion of the third particle stream via line 145 is removed from the system 100, starter particles via line 124 can be fed into the combustion vessel 125, for example.

The second hydrocarbon stream via line 142 can be fed into one or more optional heat exchange stages, e.g., a fourth heat exchanger, 150 configured or adapted to receive and cool the second hydrocarbon stream and discharge a cooled second hydrocarbon stream via line 151 therefrom. In certain embodiments, a pre-heated cooling medium, e.g., a pre-heated boiler feed water, via line 167 can be fed into the fourth heat exchange stage 150 and steam via line 152 can be obtained therefrom. In certain embodiments, the second hydrocarbon stream via line 142 or the optionally cooled hydrocarbon stream via line 151 can be fed into the distillation column 160 or optionally into one or more second quenching stages or quenching sections, e.g., a transfer line exchanger, 155. A portion of a cooled bottoms heavy oil stream via line 168 can be mixed, blended, or otherwise combined with the second hydrocarbon stream in line 142 or the optionally cooled second hydrocarbon stream in line 151 to produce a quenched second hydrocarbon stream via line 156.

The second hydrocarbon stream via line 142, the cooled second hydrocarbon stream via line 151, or the quenched second hydrocarbon stream via line 156 can be fed into the distillation column 160. The distillation column 160 can separate various hydrocarbon products from the second hydrocarbon stream in line 142, the cooled second hydrocarbon stream in line 151, or the quenched second hydrocarbon stream in line 156. In certain embodiments, the hydrocarbon products that can be obtained from the distillation column 160 can include, but are not limited to, a bottoms heavy oil stream via line 161, a side-draw gas oil stream via line 162, an overhead stream rich in naphtha and light hydrocarbons via line 163, or a combination thereof.

In certain embodiments, the bottoms heavy oil stream via line 161 and a cooling medium, e.g., boiler feed water, via line 164 can be fed into one or more optional heat exchange stages, e.g., a fifth heat exchanger, 165 and a cooled bottoms heavy oil stream via line 166 and the pre-heated cooling medium via line 167 can be discharged therefrom. In certain embodiments, a portion of the cooled bottoms heavy oil stream in line 166 can be fed via line 168 into the optional quench stage 155 as the quench medium. In certain embodiments, at least a portion of the cooled bottoms heavy oil stream via line 169 can be removed from the system 100. In certain embodiments, at least a portion of the cooled bottoms heavy oil stream via line 166 can be fed into the combustion vessel 125 as the optional fuel stream.

The overhead stream via line 163 can be fed into the recovery sub-system 170 configured or adapted to receive and separate two or more products therefrom. In certain embodiments, the recovery sub-system can be configured or adapted to obtain and discharge a naphtha stream via line 171, at least one olefin stream via line 172, and at least one hydrogen stream rich in hydrogen via line 174. In certain embodiments, the recovery sub-system can also be configured or adapted to obtain and discharge the at least one paraffin stream rich in paraffins via line 173. In certain embodiments, the paraffin stream in line 172 can include ethane, propane, butane, pentane, or any mixture thereof. In certain other embodiments, the paraffin stream in line 172 can include larger paraffins in addition to or in lieu of C2-C5 paraffins such as C6-C9 paraffins.

Returning to the first flue gas stream in line 131, the first flue gas stream via line 131 and a quench medium via line 176 can be fed into an optional quenching section 180. The quench medium in line 176 can be or can include an oxidizing agent, e.g., air. In certain embodiments, a first portion of the oxidizing agent in line 101 can be fed into the optional heat exchange stage 105 and a second portion of the oxidizing agent in line 101 can be fed into the quenching section 180. A cooled flue gas stream via line 181 can be discharged from the quenching section 180.

The flue gas stream via line 131 or the optionally cooled flue gas stream via line 181 can be fed into the further separation vessel 185 configured or adapted to receive and separate the flue gas stream or the cooled flue gas stream to obtain a second flue gas stream rich in the flue gas and a fourth particle stream rich in the particles. In certain embodiments, the fourth separation vessel 185 can include one or more cyclones 186 (two are shown) configured or adapted to separate the flue gas stream or the cooled flue gas stream to obtain the second flue gas stream and fourth particle stream.

In certain other embodiments, a stripping steam stream or fourth stripping steam stream (not shown) can be fed into the fourth separation vessel 185. If the stripping steam stream is fed into the fourth separation vessel 185, the stripping steam stream can improve or otherwise aid in separating the second flue gas and the fourth particle stream from the flue gas stream or the cooled flue gas stream.

The second flue gas stream can be discharged via line 108 from the fourth separation vessel 185. In this embodiment, the second flue gas stream can be or can make up at least a portion of the heat source or heated medium fed into the heat exchange stages 105, 106, and/or 107. The fourth particle stream via line 187 can be discharged from the fourth separation vessel 185. In certain embodiments, at least a portion of the fourth particle stream in line 187 can be removed via line 188 from the system 100. The removal of at least a portion of the fourth particle stream via line 188 can be used to control or adjust an amount of particles in the system 100 that during operation can become undesirably rich in the transition metal element disposed thereon. In certain embodiments, when at least a portion of the fourth particle stream via line 188 is removed from the system 100, starter particles via line 124 can be fed into the combustion vessel 125, for example.

It should be understood that numerous configurations of the various processing equipment can be made. For example, the first, second, third, fourth, and fifth heat exchangers 105, 106, 107, 150, and 165 can be arranged or configured to receive the heat source or heated medium via line 108 in parallel, two or more could be integrated with one another, the heated medium fed thereto can be different heated mediums, etc. The first, second, third, fourth, and fifth heat exchangers 105, 106, 107, 150, and 165 can each independently be or include any type or combination of heat exchanger. For example, the first, second, third, fourth, and fifth heat exchangers 105, 106, 107, 150, and 165 can independently be or include shell-and-tube heat exchanger, a plate and frame heat exchanger, brazed aluminum heat exchangers, a plate and fin heat exchanger, a spiral wound heat exchanger, a coil wound heat exchanger, a U-tube heat exchanger, a bayonet style heat exchanger, any other apparatus, or any combination thereof. The separation vessels 120, 130, 140, and 185 can also be similarly configured in a number of ways. Likewise, the first and second quenching stages or quenching sections 135 and 155 can also be similarly configured in a number of ways.

Figure 2A:
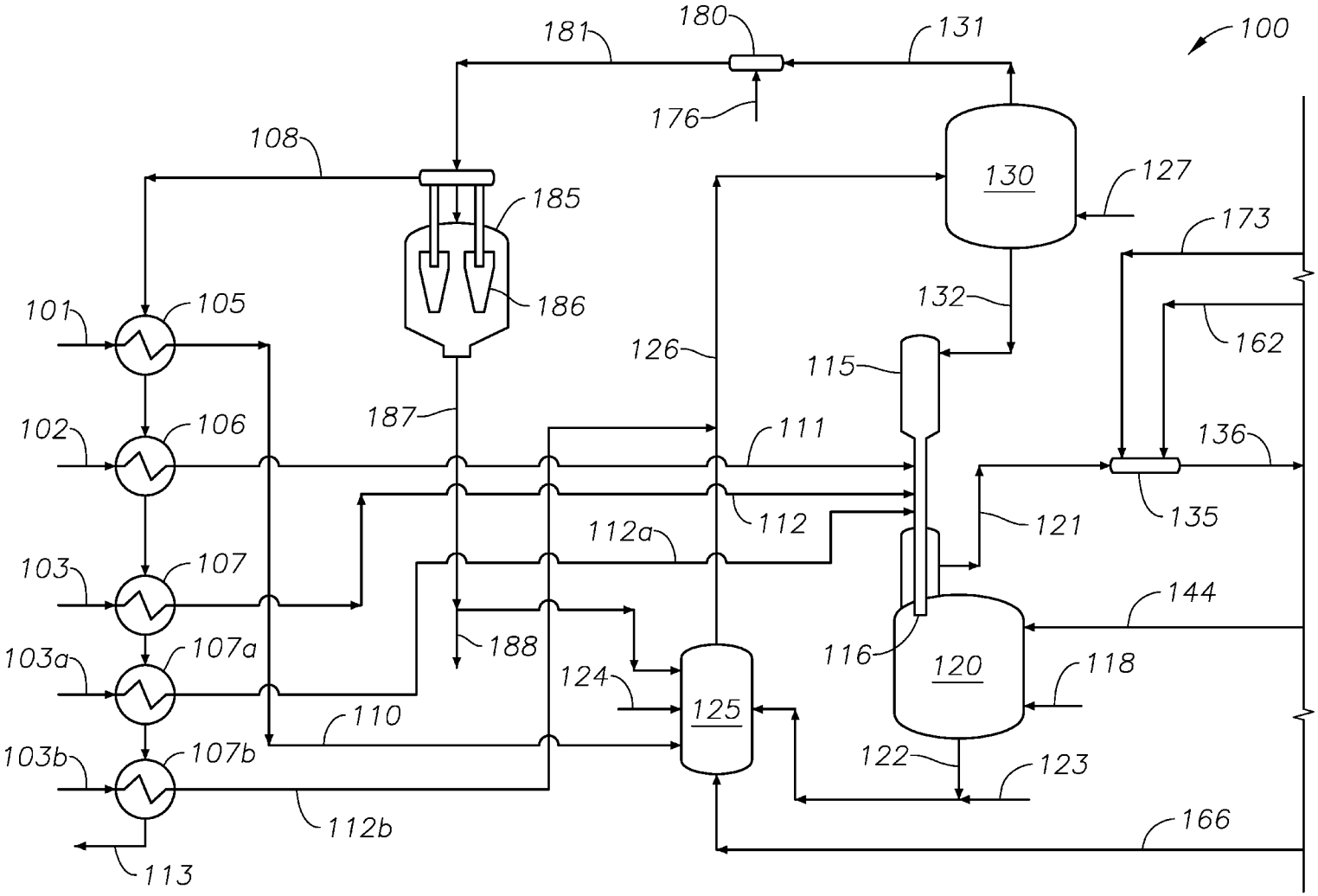
FIGS. 2A and 2B are a schematic illustration of a process/system of this disclosure for converting plastic and/or other waste materials, along with a hydrocarbon-containing.
Figure 2B:
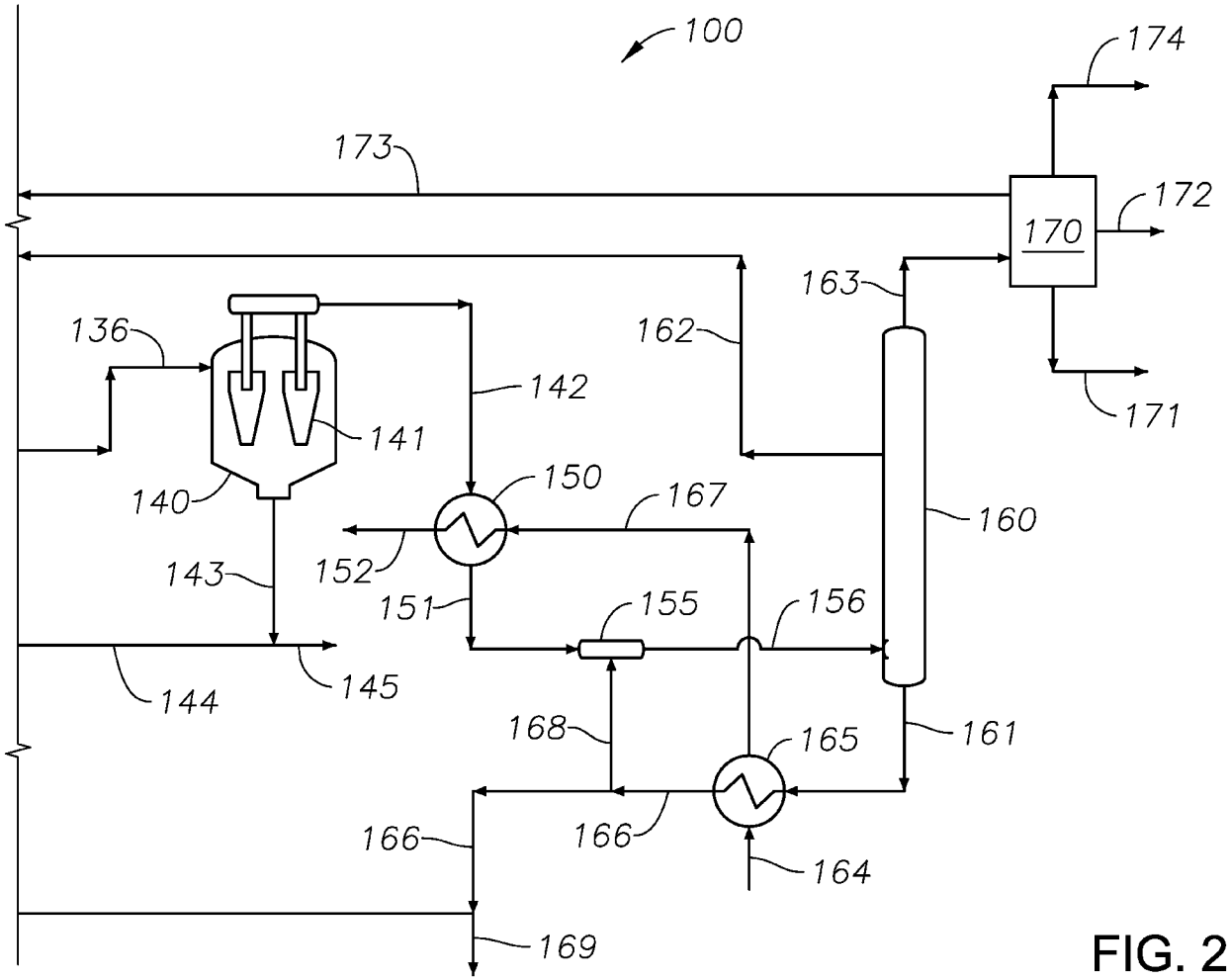

FIGS. 2A and 2B (Inventive)

FIGS. 2A and 2B, combined, schematically illustrate an inventive process/system based on the process/system of FIG. 1. As shown in FIGS. 2A and 2B, additional organic-material-containing stream 103*a* and/or 103*b* are also fed into the process/system into the first quenching zone downstream of the pyrolysis reaction zone. The organic materials contained therein are advantagedly converted into valuable chemical products including but not limited to olefins, syngas, and fuel products. The streams 103*a* and 103*b*, the same or different, can independently comprise, e.g., (i) a plastic such as a plastic waste; (ii) an industrial waste stream produced or derived from a refinery or a chemical plant; (iii) a resid-containing crude fraction, e.g., a tar stream; and (iv) any mixture of one or more of (i), (ii), (iii), and (iv). Although FIGS. 2A and 2B show both streams 103*a* and 103*b* are present and processed, it should be noted that it is also possible to feed only stream 103*a* or only stream 103*b*. In a preferred embodiment, stream 103*a* comprises a plastic such as a plastic waste. In a preferred embodiment, stream 103*b* comprises an industrial waste stream produced or derived from a refinery or a chemical plant. Both streams 103*a* and 103*b* can comprise a gas, liquid, and/or a solid phase. Where a stream of 103*a* and 103*b* comprises a solid material, e.g., a solid plastic, the solid material may take the form of pulverized particles, pellets, beads, and the like. Preferably, the solid material is carried by a fluid medium such as liquid and/or gas when fed into the process/system of this disclosure, and then transported into the various locations via pumps, conduits, valves, and the like. Such carrier medium can include, but are not limited to, steam, liquid water, methane, ethane, propane, butanes, pentanes, natural gas, syngas, naphtha, light gas oil, gas oil, distillate, vacuum gas oil, and mixtures of any two or more thereof. Specifically, with respect to stream 103*a*, especially where it comprises a solid phase of a polymer material, it is highly advantageous that the carrier medium is hydrocarbon-based, comprising hydrocarbon(s) at a concentration of, e.g., ≥50 wt %, ≥60 wt %, ≥70 wt %, ≥80 wt %, ≥90 wt %, or ≥95 wt %, based on the total weight of the carrier medium, for example, ethane, propane, butanes, pentanes, naphtha, light gas oil, heavy gas oil, distillate, vacuum gas oil, and the like. With respect to stream 103*b*, it is highly advantageous that when entering line 126, it is in gas phase only. In a preferred embodiment, stream 103*b* comprises, in addition to an organic material such as a hydrocarbon waste material, steam when entering line 126. In such embodiment, steam and the organic material entrained in stream 112*b* may react with the hot particles in line 126 to generate, inter alia, syngas.

Processing of Stream 103*a*

As shown in FIGS. 2A and 2B, stream 103*a*, e.g., a stream comprising a plastic material such as a plastic waste and a hydrocarbon-based carrier medium, is first heated by stream 108 via a heat exchanger 107*a* to obtain a heated stream 112*a*. Stream 112*a* is then fed into the first quenching zone in down-pipe 116 at a location below streams 112 and 111. The temperature of stream 112*a* when entering the first quenching zone is lower than the temperature of the first pyrolysis effluent. As such, stream 112*a* quenches the first pyrolysis effluent to a lower temperature upon contacting and mixing with the first pyrolysis effluent. The plastic material can be at least partly in solid phase in stream 112*a*. When in solid phase, the plastic material preferably is pulverized or pelletized. In certain embodiments the plastic material can be substantially entirely in liquid phase at a relatively low viscosity when entering line 116. To carry the plastic material into downpipe 116, a carrier medium, preferably a hydrocarbons-based gas and/or liquid, comprising, e.g., at least one of ethane, propane, butanes, pentanes, naphtha, light gas oil, heavy gas oil, distillate, vacuum gas oil, and the like, can be used in feed stream 103*a*.

Upon entering the first quenching zone in downpipe 116, the plastic material in stream 112*a* contacts the pyrolysis effluent exiting the pyrolysis reaction zone. The temperature of the pyrolysis effluent including the particles remains sufficiently high such that the plastic material, contacting the particles, undergo pyrolysis reactions (cracking) to produce valuable chemical products. Without intending to be bound by a particular theory, it is believed that olefins-based polymers (e.g., polyethylene at various grades, polypropylene at various grades, polypropylene at various grades, and the like) can be cracked to produce linear or branched olefins with various molecular weights, including but not limited to ethylene, propylene, butenes, pentenes, and the like, depending on the temperature of the first pyrolysis effluent, and the weight ratio of the particles in the first pyrolysis effluent and the crackable materials in stream 112*a*. Aromatic hydrocarbon-based polymers (e.g., polystyrene, and the like) can be cracked to produce benzene and benzene derivatives (e.g., vinyl benzene) and light olefins. Molecular hydrogen is also produced from the pyrolysis of the plastic material. In addition, materials in the carrier medium including but not limited to saturated hydrocarbons can undergo pyrolysis upon contacting the hot particles contained in the first pyrolysis effluent to produce, e.g., olefins such as ethylene, propylene, butenes, pentenes, naphtha, and the like. For example, the following conversion may occur with respect to certain hydrocarbons in the carrier medium:

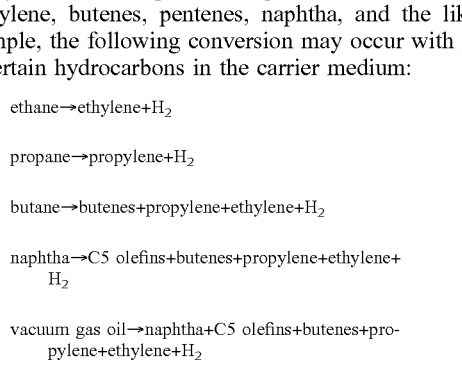

ethane→ethylene+$H_2$ propane→propylene+$H_2$ butane→butenes+propylene+ethylene+$H_2$ naphtha→C5 olefins+butenes+propylene+ethylene+$H_2$ vacuum gas oil→naphtha+C5 olefins+butenes+propylene+ethylene+$H_2$ Thus, the second pyrolysis effluent resulting from the contacting of the particles in the first pyrolysis effluent with the plastic material can comprise, compared to the first pyrolysis effluent, additional quantities of valuable chemicals such as olefins, aromatic hydrocarbons, naphtha, and the like. The second pyrolysis mixture can be separated downstream to recover at least one of an olefin product, a fuel product, and the like.

Pyrolysis of plastic materials and other high-molecular weight organic materials to produce light olefins typically requires an elevated temperature. Thanks to the residual heat entrained in the particles in the first pyrolysis effluent, the contacting of the polymer materials with the particles downstream of the first pyrolysis zone can still effect the pyrolysis of the plastic material to produce various chemical products and/or fuel products.

The second pyrolysis effluent can have a temperature that is t1 to t2° C. lower than the temperature of the first pyrolysis effluent, where t1 and t2 can be, independently, 10, 15, 20, 25, 30, 35, 40, 45, 50, 55, 60, 65, 70, 75, 80, 85, 90, 95, 100, 120, 140, 150, 160, 180, 200, as long as t1<t2. The temperature of the second pyrolysis effluent can be adjusted by, e.g., altering the temperature of stream 112*a* before it is fed into the first quenching zone; altering the weight ratio of the first pyrolysis effluent to stream 112*a*; adjusting the composition of the stream 112*a*, and the like.

As shown in FIGS. 2A and 2B, similar to the process/system of FIG. 1, the second pyrolysis effluent then exits the end of downpipe 116 into vessel 120, where it is separated into a particles-rich stream to enter line 122 and a first hydrocarbon-rich stream 121. Streams 122 and 121 can be processed similar to the process of FIG. 1 as described above.

Specifically, with respect to embodiments of the processes of this disclosure involving feeding a high-molecular weight organic material-containing first quenching stream 103*a* (e.g., a stream comprising a polymer material) into the first quenching zone, the pyrolysis of the organic material can result in the formation of coke on the surface of the particles. While in many chemical processes coke formation is highly undesirable and can cause fouling of the system, in the processes of this disclosure, such coke deposited on the particles can be combusted in the combustion zone 125 once the particles in stream 12 are recycled thereto as described above, to provide the heat to raise the temperature of the particles, e.g. As such, plastic material-containing streams 103*a* can be advantageously used as the first quenching stream in the processes of this disclosure to produce additional quantity of valuable chemical products and/or fuel products. Thus, the processes and systems of this disclosure can be particularly robust and reliable for recycling plastic waste.

Processing of Stream 103*b*

As shown in FIGS. 2A and 2B, stream 103*b*, e.g., a stream comprising a second organic material such as an industrial waste (e.g., steam cracker tar fraction, a water-containing stream from the boots of fractionators, and the like), is first heated by stream 108 via a heat exchanger 107*b* to obtain a heated stream 112*b*. Stream 103*b* can comprise water in addition to the second organic material. Stream 103*b* can comprise a gas phase, a liquid phase, and/or a solid phase. In preferred embodiments, stream 103*b* consists of a gas phase and/or a liquid phase. In preferred embodiments, stream 112*b* consists of a gas phase. Stream 112*b* is then fed into a gasifying zone in line 126 downstream (preferably immediately downstream, e.g., at the exit) of combustion zone 125. To carry heavy materials in stream 103*b* into line 126, a carrier medium, preferably a hydrocarbons-based gas and/or liquid, comprising, e.g., at least one of ethane, propane, butanes, pentanes, naphtha, light gas oil, can be included in feed stream 103*a*. In another preferred embodiment, the carrier medium in stream 112*b* comprises water (e.g., steam), which can be derived conveniently from water-containing industrial streams without the need of separation.

Upon entering the first gasifying zone in line 126, the second organic materials in stream 112*b* contacts the combustion zone effluent having exited the combustion zone 125. The temperature of the combustion zone effluent including the particles therein are sufficiently high such that the second organic material undergo pyrolysis reactions (cracking) and gasifying reactions to produce molecular hydrogen and CO (i.e., syngas with various ratio of molecular hydrogen to CO). For example, the following conversion may occur in the gasifying zone when the second organic material contacts the hot particles contained in the combustion zone effluent:

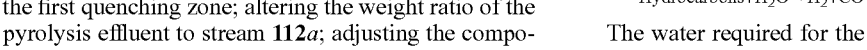

Hydrocarbons+$H_2O$→$H_2$+CO

The water required for the above reactions can be partly or entirely from stream 103*b*, or alternatively, separately fed into the gasifying zone where necessary. The gas/particle mixture stream produced in the gasifying zone (i.e., the gasifying zone effluent) then enters into the second separation vessel 130, where it is separated and then processed similar to the process of FIG. 1 as described above. In a process of this disclosure, however, as a result of the gasifying reactions in the gasifying zone of the second organic materials, streams 131, 181, 108 and 113 can comprise a mixture of molecular hydrogen and CO, which can be processed into valuable syngas products. Such syngas products can be advantageously used for various chemical synthesis process, e.g., Fischer-Tropsh processes for making various chemicals such as alkanes.

Any organic material can be included as the second organic material in stream 103*b* and then converted into syngas on contacting the combustion zone effluent in the processes of this disclosure. Such second organic material can preferably include a waste stream produced in a refinery and/or chemical plant, including but are not limited to: tank bottom streams; steam cracker tar; fluid catalytic cracker tar; lube extract, heavy aromatic hydrocarbons, fuel oils, and bio-oils.

Compared to the processes of FIG. 1, the processes of this disclosure further include at least one of steps (a) and (b): (a) feeding a first organic-material-containing stream (e.g., a plastic-containing stream) into a first quenching zone downstream (preferably immediately downstream) of the pyrolysis zone to effect the pyrolysis of at least a portion of the first organic material; and (b) feeding a second organic-material-containing stream (e.g., an industrial waste stream) into the gasifying zone downstream (preferably immediately downstream) of the combustion zone. Step (a) allows for the rapid quenching of the first pyrolysis effluent to a lower temperature while converting the first organic material into additional quantity of valuable chemical and/or fuel products by making beneficial use of the residual heat retained in the particles in the pyrolysis particles. Step (a) allows for advantaged recycle of plastic wastes. Step (b) allows for the conversion of any waste material containing the second organic material into valuable syngas.

Listing of Embodiments

This disclosure may further include the following non-limiting embodiments.

A1. A process for converting a hydrocarbon-containing feed by pyrolysis, comprising:

(I) feeding the hydrocarbon-containing feed into a pyrolysis reaction zone;

(II) feeding a plurality of fluidized particles having a first temperature into the pyrolysis reaction zone, wherein the first temperature is sufficiently high to enable pyrolysis of at least a portion of the hydrocarbon-containing feed on contacting the particles;

(III) contacting at least a portion of the hydrocarbon-containing feed with the particles in the pyrolysis reaction zone to effect pyrolysis of at least a portion of the hydrocarbon-containing feed to produce a first pyrolysis effluent comprising olefins, hydrogen, and the particles;

(IV) contacting at least a portion of the particles in the first pyrolysis effluent downstream of the pyrolysis reaction zone with a first quenching stream comprising an organic material to effect the pyrolysis of at least a portion of the organic material in the first quenching stream and obtain a second pyrolysis effluent comprising olefins, hydrogen, and the particles; and (V) separating the second pyrolysis effluent to obtain a first hydrocarbon stream rich in hydrocarbons and a first particle stream rich in the particles.

A2. The process of A1, wherein the organic material contained in the first quenching stream comprises (i) a plastic waste, (ii) a hydrocarbon present in an industrial waste stream, (iii) a resid-containing crude fraction, or (iv) any mixture of two or more of (i), (ii), and (iii).

A3. The process of A1 or A2, further comprising:

(VI) heating at least a portion of the particles in the first particle stream in a combustion zone; and (VII) feeding at least a portion of the heated particles to the pyrolysis reaction zone as at least a portion of the plurality of fluidized particles fed into the pyrolysis reaction zone in step (II).

A4. The process of any of A1 to A3, wherein step (IV) is carried out by contacting the first quenching stream with the first pyrolysis effluent before a separation of a portion of the particles from the first pyrolysis effluent stream.

A5. The process of any of A1 to A4, wherein the first pyrolysis effluent has a temperature in a range from 600 to 900° C. (e.g., 600, 650, 700, 750, 800, 850, 900° C.) immediately before contacting the organic-waste-containing stream in step (IV).

A6. The process of any of A1 to A3, wherein step (IV) is carried out by contacting the first quenching stream with a stream rich in the particles separated from the first pyrolysis stream.

A7. The process of any of A1 to A6, wherein the first quenching stream has a temperature in a range from 200 to 600° C. (e.g., 200, 250, 300, 350, 400, 450, 500, 550, 600° C.) immediately before contacting the first pyrolysis effluent.

A8. The process of any of A1 to A7, wherein step (VI) comprises:

(VIa) feeding at least a portion of the first particle stream into the combustion zone;

(VIb) feeding an oxidizing gas stream into the combustion zone;

(VIc) feeding an optional fuel into the combustion zone;

(VId) reacting the oxidizing gas with the particles in the first particle stream and/or the optional fuel to provide heat energy; and (VIe) heating the particles in the combustion zone.

A9. The process of A8, wherein in step (VIc), the optional fuel is provided at least partly by a first organic-waste-containing stream.

A10. The process of any of A1 to A9, wherein the first organic-waste-containing stream comprises at least partly an industrial waste stream.

A11. The process of any of A1 to A10, further comprising between steps (VI) and (VII):

(VIII) contacting at least a portion of the heated particles with a second organic-material-containing stream to produce a gas/particle mixture stream comprising molecular hydrogen and/or CO.

A12. The process of A11, wherein the second organic-material-containing stream comprises at least partly an industrial waste stream.

A13. The process of A11 or A12, wherein the contacting in step (VIII) is carried out at a temperature of the heated particles in a range from 1000 to 1400° C. (e.g., 1000, 1050, 1100, 1150, 1200, 1250, 1300, 1350, 1400° C.), and a residence time in a range from 20 to 5000 ms (e.g., 20, 30, 40, 50, 60, 70, 80, 90, 100, 150, 200, 250, 300, 350, 400, 450, 500 ms).

A14. The process of any of A11 to A13, wherein the first quenching stream, the first organic-waste-containing stream, and the second organic-material-containing stream, the same or different, independently comprises (i) a plastic waste, (ii) a hydrocarbon present in an industrial waste stream, (iii) a resid-containing crude fraction, or (iv) any mixture of two or more of (i), (ii), and (iii).

A15. The process of A14, wherein the first quenching stream, the first organic-waste-containing stream, the second organic-material-containing stream, the same or different, further independently comprises a carrier comprising one or more of steam, methane, ethane, propane, a naphtha, a gas oil, a vacuum gas oil, and mixtures thereof.

A16. The process of any of A10 to A15, wherein the second organic-material-containing stream comprises at least partly an industrial waste stream.

A17. The process of A16, wherein the second organic-material-containing stream comprises water.

A18. The process of any of A1 to A17, wherein in the pyrolysis zone, the first temperature is in a range from 800 to 1400° C.

A19. The process of any of A1 to A18, wherein the weight ratio of the particles to the hydrocarbon-containing feed is in a range from 10:1 to 50:1.

A20. The process of any of A1 to A19, wherein the contacting in the pyrolysis reaction zone in step (III) has a residence time from 10 to 2,000 milliseconds.

A21. The process of any of A1 to A20, wherein the contacting in the pyrolysis reaction zone in step (III) is performed under an absolute pressure from 200 kPa to 700 kPa.

A22. The process of any of A1 to A21, wherein the plurality of particles comprises one or more of a glass material, a ceramic material, a glass-ceramic material, a crystalline material, coke, and any mixture thereof.

A23. The process of any of A3 to A21, further comprising, after step (VI) and before step (VII), the following steps:

(VI-1) separating the combustion zone effluent and/or the gas/particle mixture stream into a second particle stream rich in the heated particles and a gas stream;

(VI-2) separating the particles, if any, contained in the gas stream using a cyclone; and (VI-3) feeding at least a portion of the particles separated in step (VI-2) to the combustion zone.

A24. The process of any of A11 to A23, wherein the gas/particle mixture stream and/or the gas stream comprises molecular hydrogen and CO.

A25. The process of any of A1 to A24, further comprising:

(IX) quenching the first hydrocarbon stream.

A26. The process of A25, further comprising:

(X) separating the quenched first hydrocarbon stream to obtain a second hydrocarbon stream rich in hydrocarbons and a third particle stream rich in the particles; and (XI) feeding at least a portion of the particles in the third particle stream to the combustion zone.

A27. The process of A26, further comprising:

(XII) obtaining from the second hydrocarbon stream a gas oil stream and a bottoms heavy stream.

A28. The process of A27, further comprising at least one of the following steps:

(XIII) quenching the first hydrocarbon stream at least partly using at least a portion of the gas oil stream; and (XIV) feeding at least a portion of bottoms heavy stream to the combustion zone as a fuel for oxidation.

A29. The process of any of A1 to A28, further comprising:

(XV) recovering at least an olefin product from at least a portion of the first hydrocarbon stream and/or the second hydrocarbon stream in a first product recovery system.

A30. The process of any of A1 to A29, wherein the hydrocarbon-containing feed is provided by:

(XV) feeding a gas-liquid mixture of a resid-containing feed into a flashing drum;

(XVI) obtaining from the flashing drum a flashing drum vapor effluent and a flashing drum liquid effluent; and (XVII) providing at least a portion of the flashing drum liquid effluent as at least a portion of the hydrocarbon-containing feed.

A31. The process of A30, further comprising:

(XVIII) feeding at least a portion of the flashing drum vapor effluent into a steam cracker operated under steam cracking conditions;

(XIX) obtaining a steam cracker mixture effluent from the steam cracker; and (XX) recovering at least an olefin product from the steam cracker effluent, optionally in the first product recovery system.

A32. A process for converting an organic-material-containing feed, the process comprising:

(I) feeding a hydrocarbon-containing feed into a pyrolysis reaction zone;

(II) feeding a plurality of fluidized particles having a first temperature into the pyrolysis reaction zone, wherein the first temperature is sufficiently high to enable pyrolysis of at least a portion of the hydrocarbon-containing feed on contacting the particles;

(III) contacting at least a portion of the hydrocarbon-containing feed with the particles in the pyrolysis reaction zone to effect pyrolysis of at least a portion of the hydrocarbon-containing feed to produce a first pyrolysis effluent comprising olefins, hydrogen, and the particles;

(IV) optionally contacting at least a portion of the particles in the first pyrolysis effluent downstream of the pyrolysis reaction zone with a first quenching stream comprising a first organic material to effect the pyrolysis of at least a portion of the first organic material and to obtain a second pyrolysis effluent comprising olefins, hydrogen, and the particles;

(V) separating the second pyrolysis effluent to obtain a first hydrocarbon stream rich in hydrocarbons and a first particle stream rich in the particles;

(VI) heating at least a portion of the particles in the first particle stream in a combustion zone;

(VII) feeding at least a portion of the heated particles to the pyrolysis reaction zone as at least a portion of the plurality of fluidized particles fed into the pyrolysis reaction zone in step (II); and (VIII) optionally between steps (VI) and (VII), contacting at least a portion of the heated particles with a second organic-material-containing stream comprising a second organic material;

wherein at least one of steps (IV) and (VIII) is carried out.

A33. The process of A32, wherein the first quenching stream and/or the second organic-material-containing stream comprise (i) a plastic; (ii) an organic material in an industrial waste stream; (iii) a resid-containing crude fraction; or (iv) a mixture of any of two or more of (i), (ii), and (iii).

A34. The process of A32 or A33, wherein at least one of the following is met:

(a) the first quenching stream comprises a plastic; and (b) the second organic-material-containing stream comprises a hydrocarbon contained in an industrial waste stream.

A35. The process of any of A32 to A34, wherein both steps (IV) and (VIII) are carried out.

A36. The process of any of A32 to A35, wherein step (IV) is carried out by contacting the first quenching stream with the first pyrolysis effluent before a separation of a portion of the particles from the first pyrolysis effluent stream.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for converting a hydrocarbon-containing feed by pyrolysis, comprising:

(I) feeding the hydrocarbon-containing feed into a pyrolysis reaction zone;

(II) feeding a plurality of fluidized particles having a first temperature into the pyrolysis reaction zone, wherein the first temperature is sufficiently high to enable pyrolysis of at least a portion of the hydrocarbon-containing feed on contacting the particles;

(III) contacting at least a portion of the hydrocarbon-containing feed with the particles in the pyrolysis reaction zone to effect pyrolysis of at least a portion of the hydrocarbon-containing feed to produce a first pyrolysis effluent comprising olefins, hydrogen, and the particles;

(IV) contacting at least a portion of the particles in the first pyrolysis effluent downstream of the pyrolysis reaction zone with a first quenching stream comprising an organic material to effect the pyrolysis of at least a portion of the organic material in the first quenching stream and obtain a second pyrolysis effluent comprising olefins, hydrogen, and the particles;

(V) separating the second pyrolysis effluent to obtain a first hydrocarbon stream rich in hydrocarbons and a first particle stream rich in the particles;

(IX) quenching the first hydrocarbon stream;

(X) separating the quenched first hydrocarbon stream to obtain a second hydrocarbon stream rich in hydrocarbons and a third particle stream rich in the particles;

(XI) feeding at least a portion of the particles in the third particle stream to the combustion zone;

(XII) obtaining from the second hydrocarbon stream a gas oil stream and a bottoms heavy stream;

(XIII) quenching the first hydrocarbon stream at least partly using at least a portion of the gas oil stream; and (XIV) feeding at least a portion of bottoms heavy stream to the combustion zone as a fuel for oxidation.

2. The process of claim 1, wherein the organic material contained in the first quenching stream comprises (i) a plastic waste, (ii) a hydrocarbon present in an industrial waste stream, (iii) a resid-containing crude fraction, or (iv) any mixture of two or more of (i), (ii), and (iii).

3. The process of claim 1, further comprising:

(VI) heating at least a portion of the particles in the first particle stream in a combustion zone; and (VII) feeding at least a portion of the heated particles to the pyrolysis reaction zone as at least a portion of the plurality of fluidized particles fed into the pyrolysis reaction zone in step (II).

4. The process of claim 1, wherein step (IV) is carried out by contacting the first quenching stream with the first pyrolysis effluent before a separation of a portion of the particles from the first pyrolysis effluent stream.

5. The process of claim 4, wherein the first pyrolysis effluent has a temperature in a range from 600 to 900° C. immediately before contacting the first quenching stream in step (IV).

6. The process of claim 1, wherein step (IV) is carried out by contacting the first quenching stream with a stream rich in the particles separated from the first pyrolysis stream.

7. The process of claim 1, wherein the first quenching stream has a temperature in a range from 200 to 400° C. immediately before contacting the first pyrolysis effluent.

8. The process of claim 3, wherein step (VI) comprises:

(VIa) feeding at least a portion of the first particle stream into the combustion zone;

(VIb) feeding an oxidizing gas stream into the combustion zone;

(VIc) optionally feeding an fuel into the combustion zone;

(VId) reacting the oxidizing gas with the particles in the first particle stream and/or the optional fuel to provide heat energy; and (VIe) heating the particles in the combustion zone.

9. The process of claim 3, further comprising between steps (VI) and (VII):

(VIII) contacting at least a portion of the heated particles with a second organic-material-containing stream to produce a gas/particle mixture stream comprising molecular hydrogen and/or CO.

10. The process of claim 9, wherein the contacting in step (VIII) is carried out at a temperature of the heated particles in a range from 1000 to 1400° C., and a residence time in a range from 100 to 2000 ms, such that the gas/particle mixture stream has a temperature in a range from 550 to 900° C.

11. The process of claim 9, wherein the first quenching stream and/or the second organic-material-containing stream, which are the same or different, further independently comprise a carrier comprising one or more of steam, methane, ethane, propane, a naphtha, a gas oil, a vacuum gas oil, and mixtures thereof.

12. The process of claim 9, wherein the second organic-material-containing stream comprises water.

13. The process of claim 1, wherein in the pyrolysis zone, the first temperature is in a range from 800 to 1400° C.

14. The process of claim 1, wherein at least one of the following is met:

the weight ratio of the particles to the hydrocarbon-containing feed is in a range from 10:1 to 50:1;

the contacting in the pyrolysis reaction zone in step (III) has a residence time from 10 to 2,000 milliseconds; and the contacting in the pyrolysis reaction zone in step (III) is performed under an absolute pressure from 200 kPa to 700 kPa.

15. The process of claim 3, further comprising, after step (VI) and before step (VII), the following steps:

(VI-1) separating the combustion zone effluent and/or the gas/particle mixture stream into a second particle stream rich in the heated particles and a gas stream;

(VI-2) separating the particles, if any, contained in the gas stream using a cyclone; and (VI-3) feeding at least a portion of the particles separated in step (VI-2) to the combustion zone.

16. The process of claim 9, wherein the gas/particle mixture stream comprises molecular hydrogen and CO.

17. The process of claim 1, further comprising:

(XV) recovering at least an olefin product from at least a portion of the first hydrocarbon stream and/or the second hydrocarbon stream in a first product recovery system.

18. The process claim 1, wherein the hydrocarbon-containing feed is provided by:

(XV) feeding a gas-liquid mixture of a resid-containing feed into a flashing drum;

(XVI) obtaining from the flashing drum a flashing drum vapor effluent and a flashing drum liquid effluent; and (XVII) providing at least a portion of the flashing drum liquid effluent as at least a portion of the hydrocarbon-containing feed.

19. The process of claim 18, further comprising:

(XVIII) feeding at least a portion of the flashing drum vapor effluent into a steam cracker operated under steam cracking conditions;

(XIX) obtaining a steam cracker mixture effluent from the steam cracker; and (XX) recovering at least an olefin product from the steam cracker effluent.

20. A process for converting a hydrocarbon-containing feed by pyrolysis, comprising:

(Ia) obtaining at least a portion of the hydrocarbon-containing feed by:

(Ia-1) feeding a gas-liquid mixture of a resid-containing feed into a flashing drum;

(Ia-2) obtaining from the flashing drum a flashing drum vapor effluent and a flashing drum liquid effluent; and (Ia-3) providing at least a portion of the flashing drum liquid effluent as at least a portion of the hydrocarbon-containing feed;

(I) feeding the hydrocarbon-containing feed into a pyrolysis reaction zone;

(II) feeding a plurality of fluidized particles having a first temperature into the pyrolysis reaction zone, wherein the first temperature is sufficiently high to enable pyrolysis of at least a portion of the hydrocarbon-containing feed on contacting the particles;

(III) contacting at least a portion of the hydrocarbon-containing feed with the particles in the pyrolysis reaction zone to effect pyrolysis of at least a portion of the hydrocarbon-containing feed to produce a first pyrolysis effluent comprising olefins, hydrogen, and the particles;

(IV) contacting at least a portion of the particles in the first pyrolysis effluent downstream of the pyrolysis reaction zone with a first quenching stream comprising an organic material to effect the pyrolysis of at least a portion of the organic material in the first quenching stream and obtain a second pyrolysis effluent comprising olefins, hydrogen, and the particles;

(V) separating the second pyrolysis effluent to obtain a first hydrocarbon stream rich in hydrocarbons and a first particle stream rich in the particles;

(XVIII) feeding at least a portion of the flashing drum vapor effluent into a steam cracker operated under steam cracking conditions;

(XIX) obtaining a steam cracker mixture effluent from the steam cracker; and (XX) recovering at least an olefin product from the steam cracker effluent, optionally in the first product recovery system.

21. The process of claim 20, wherein the first quenching stream comprises (i) a plastic; (ii) an organic material in an industrial waste stream; (iii) a resid-containing crude fraction; or (iv) a mixture of any of two or more of (i), (ii), and (iii).

* * * * *